US010643782B2

(12) United States Patent
Zhou et al.

(10) Patent No.: US 10,643,782 B2
(45) Date of Patent: May 5, 2020

(54) MAGNETIC COMPONENT AND POWER MODULE

(71) Applicant: Delta Electronics (Shanghai) Co., Ltd., Shanghai (CN)

(72) Inventors: Jinping Zhou, Shanghai (CN); Mingzhun Zhang, Shanghai (CN)

(73) Assignee: DELTA ELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/527,829

(22) Filed: Jul. 31, 2019

(65) Prior Publication Data

US 2019/0378643 A1 Dec. 12, 2019

Related U.S. Application Data

(63) Continuation-in-part of application No. 16/259,721, filed on Jan. 28, 2019, now Pat. No. 10,438,736, (Continued)

(30) Foreign Application Priority Data

Oct. 28, 2016 (CN) ..... 2016 1 0969989
May 5, 2017 (CN) ..... 2017 1 0312684
(Continued)

(51) Int. Cl.
*H01F 27/24* (2006.01)
*H01F 27/28* (2006.01)
*H01F 27/29* (2006.01)

(52) U.S. Cl.
CPC ..... *H01F 27/2804* (2013.01); *H01F 27/24* (2013.01); *H01F 27/2823* (2013.01); *H01F 27/29* (2013.01)

(58) Field of Classification Search
CPC .. H01F 27/2804; H01F 27/24; H01F 27/2823; H01F 27/29; H01F 17/043;
(Continued)

(56) References Cited

U.S. PATENT DOCUMENTS 7,289,329 B2 10/2007 Chen et al.
10,373,754 B2 * 8/2019 Lu ..... H02M 3/00
(Continued)

FOREIGN PATENT DOCUMENTS

CN 203659591 U 6/2014
CN 104021920 A 9/2014
(Continued)

*Primary Examiner* — Adolf D Berhane
(74) *Attorney, Agent, or Firm* — Kirton McConkie; Evan R. Witt

(57) ABSTRACT

A magnetic component and a power module using the same are provided. The magnetic component includes a magnetic core, a first winding set and a second winding set. The magnetic core includes two connecting portions connected through three magnetic columns to form two opposite sides. Each connecting portion includes a pair of first air gaps spaced apart by the middle magnetic column. The first winding set and the second winding set are made by a flat conductive body, respectively, and spaced apart at a distance. The first winding set includes two first conducting portions connected through a first horizontal portion. The second winding set includes two second conducting portions connected through a second horizontal portion. The first horizontal portion and the second horizontal portion are exposed to the first side, and the two first conducting portions and the two second conducting portions are extended to the second side.

20 Claims, 35 Drawing Sheets

Related U.S. Application Data which is a continuation-in-part of application No. 15/920,548, filed on Mar. 14, 2018, now Pat. No. 10,242,791, which is a continuation-in-part of application No. 15/784,864, filed on Oct. 16, 2017, now Pat. No. 10,062,499.

(30) Foreign Application Priority Data

May 5, 2017 (CN) ..... 2017 1 0313185
Jan. 7, 2019 (CN) ..... 2019 1 0013480
Jul. 12, 2019 (CN) ..... 2019 1 0628129

(58) Field of Classification Search
CPC ..... H01F 27/255; H01F 27/28; H01L 27/02; H05K 1/11; H05K 1/115; H05K 1/181; H05K 1/185; H02M 3/04
See application file for complete search history.

(56) References Cited

U.S. PATENT DOCUMENTS

| | | | | |
|---|---|---|---|---|
| 10,438,736 | B2 * | 10/2019 | Zhou | H01F 41/04 |
| 10,504,641 | B2 * | 12/2019 | Lu | H01F 37/00 |
| 2004/0174241 | A1 | 9/2004 | He et al. | |
| 2009/0167477 | A1 | 7/2009 | Feng et al. | |
| 2010/0007451 | A1 | 1/2010 | Yan et al. | |
| 2014/0085848 | A1 | 3/2014 | Zeng et al. | |
| 2015/0194254 | A1 | 7/2015 | Dai et al. | |
| 2016/0141088 | A1 | 5/2016 | Dai et al. | |
| 2016/0181001 | A1 | 6/2016 | Doljack et al. | |
| 2016/0300659 | A1 | 10/2016 | Zhang et al. | |
| 2017/0104419 | A1 | 4/2017 | Zeng et al. | |
| 2017/0141695 | A1 | 5/2017 | Zeng et al. | |
| 2017/0250025 | A1 | 8/2017 | Wei et al. | |
| 2017/0287615 | A1 | 10/2017 | Lu et al. | |
| 2017/0301961 | A1 | 10/2017 | Kim et al. | |
| 2018/0122562 | A1 * | 5/2018 | Ji | H01F 27/2847 |
| 2018/0124922 | A1 | 5/2018 | Ji et al. | |

FOREIGN PATENT DOCUMENTS

| | | | |
|---|---|---|---|
| CN | 104966604 | A | 10/2015 |
| CN | 104980003 | A | 10/2015 |
| CN | 105810406 | A | 7/2016 |
| WO | 2011088777 | A1 | 7/2011 |

* cited by examiner

1b

9

1h

1k

1m

1r

MAGNETIC COMPONENT AND POWER MODULE

CROSS-REFERENCE TO RELATED APPLICATION

This application claims priorities to China Patent Application No. 201910628129.X filed on Jul. 12, 2019 and No. 201910013480.8 filed on Jan. 7, 2019. This application is a continuation-in-part application of U.S. application Ser. No. 16/259,721 filed on Jan. 28, 2019, and entitled "MAGNETIC COMPONENT AND MANUFACTURING METHOD THEREOF", which is a continuation-in-part application of U.S. application Ser. No. 15/920,548 filed on Mar. 14, 2018, and entitled "POWER MODULE AND MAGNETIC COMPONENT THEREOF", which is a continuation-in-part application of U.S. application Ser. No. 15/784,864 filed on Oct. 16, 2017, and entitled "COUPLED-INDUCTOR MODULE AND VOLTAGE REGULATING MODULE COMPRISING THE SAME". The entire contents of the above-mentioned patent applications are incorporated herein by reference for all purposes.

FIELD OF THE INVENTION

The present disclosure relates to a magnetic component, and more particularly to a magnetic component with low profile height, small leakage magnetic flux and a power module using the same.

BACKGROUND OF THE INVENTION

In recent years, with the development of technologies such as data center, artificial intelligence and the like, the CPU, the GPU and the various integrated circuits (ICs) have increasingly higher speed and larger working current. Consequently, an increasingly stricter requirement is imposed to the power density, efficiency and dynamic performance of the voltage regulating module (VRM) serving for powering the CPU, the GPU and the various integrated circuits (ICs), and makes a greater challenge to the design of the VRM. In the voltage regulating module, the output inductor usually has the greatest volume, and the selection of the inductance would directly affect the efficiency and dynamic performance of the entire VRM. One approach to reduce the volume of the inductor and improve the efficiency and dynamic performance of the inductor is adopting an inverse-coupled-inductor module, which is a trend of VRM design currently. However, the conventional inverse-coupled-inductor module usually has a greater height and thus cannot be applied to some conditions with relatively high requirements on VRM height.

For a conventional coupled inductor structure, if the basic structure adopts a vertical magnetic flux structure, the plane of the magnetic flux is vertical to the plane of pins, and the height of the overall inductor includes the height of the two layers of magnetic cores and the height of the two layers of winding sets. The overall height of structure is high. Alternatively, if the basic structure adopts a horizontal magnetic flux structure, the plane of the magnetic flux is parallel to the plane of pins, and the height of the overall inductor includes the height of one layer of magnetic core and the height of two layers of winding sets. It benefits to reduce the overall height. However, in the application of thin inductors, the footprint is larger and the magnetic flux distribution is very uneven. Furthermore, the combination of the magnetic core and the winding sets is often labor intensive.

Therefore, there is a need of providing a magnetic component and a power module using the same to overcome the above drawbacks.

SUMMARY OF THE INVENTION

An aspect of the present disclosure is to provide a magnetic component. The magnetic core and the winding sets are combined to form a low profile magnetic component. The overall height of the magnetic component is thin and suitable for applications critical to the requirements of height. The thickness and cross-sectional area of the winding sets are large, and the DC resistance is small, which can reduce the loss of the winding sets of the inductor and strengthen the strength of the structure at the same time. Moreover, it benefits to obtain lower thermal resistance in the height direction through the exposure of the winding sets and the extension of the connection terminals. In addition, for some embodiments, the manufacturing process of the magnetic component is simplified, the winding sets can be pre-formed, and it is not necessary to bend the winding sets together with the magnetic core to damage the magnetic core. Consequently, the purposes of simplifying the manufacturing process and reducing the production cost are achieved at the same time. On the other hand, the dimensional design and the selected materials of the magnetic core are more conducive to optimizing the performance of the magnetic component.

In accordance with an aspect of the present disclosure, a magnetic component is provided. The magnetic core includes a first magnetic column, a second magnetic column, a third magnetic column, a first connecting portion and a second connecting portion. The first connecting portion and the second connecting portion are connected with each other through the first magnetic column, the second magnetic column and the third magnetic column to form a first side and a second side. The first side and the second side are opposite to each other. The first magnetic column is located between the second magnetic column and the third magnetic column. Each of the first connecting portion and the second connecting portion includes a pair of first air gaps, respectively. The pair of first air gaps spatially correspond to two opposite lateral sides of the first magnetic column, respectively. The first winding set and the second winding set are respectively made by a flat conductive body in flatwise winding on the first magnetic column, and spaced apart with each other at a distance. The first winding set includes a first horizontal portion and two first conducting portions, and the two first conducting portions are connected to each other through the first horizontal portion. The second winding set includes a second horizontal portion and two second conducting portions, and the two second conducting portions are connected to each other through the second horizontal portion. The first horizontal portion and the second horizontal portion are at least partially exposed to the first side. The two first conducting portions and the two second conducting portions are extended to the second side to form two surface mounting pads of the first winding set and two mounting pads of the second winding set, respectively.

In accordance with another aspect of the present disclosure, a magnetic component is provided. The magnetic core includes a first magnetic column, a second magnetic column, a third magnetic column, a first connecting portion, a second connecting portion and a third connecting portion. The first connecting portion and the second connecting portion are connected with each other through the first magnetic column, the second magnetic column and the third magnetic column to form a first side and a second side. The first side and the second side are opposite to each other. The first magnetic column is located between the second magnetic column and the third magnetic column, and the third connecting portion is located between the first connecting portion and the second connecting portion. The third connecting portion has a relative permeability lower than that of each of the first magnetic column, the second magnetic column, the third magnetic column, the first connecting portion and the second connecting portion. The first winding set and the second winding set are disposed on the first magnetic column of the magnetic core, and spaced apart by the third connecting portion. The first winding set includes a first horizontal portion and two first conducting portions, and the two first conducting portions are connected to each other through the first horizontal portion. The second winding set includes a second horizontal portion and two second conducting portions, and the two second conducting portions are connected to each other through the second horizontal portion. The first horizontal portion and the second horizontal portion are at least partially exposed to the first side, and the two first conducting portions and the two second conducting portions are extended to the second side. The first winding set and the second winding set are made by a flat conductive body, respectively.

In accordance with an additional aspect of the present disclosure, a power module is provided. The power module includes a magnetic component, a first switch unit and a second switch unit. The magnetic component includes a magnetic core, a first winding set and a second winding set. The magnetic core includes a first magnetic column, a second magnetic column, a third magnetic column, a first connecting portion and a second connecting portion. The first connecting portion and the second connecting portion are connected with each other through the first magnetic column, the second magnetic column and the third magnetic column to form a first side and a second side. The first side and the second side are opposite to each other. The first magnetic column is located between the second magnetic column and the third magnetic column. Each of the first connecting portion and the second connecting portion includes a pair of first air gaps, respectively. The pair of first air gaps spatially correspond to two opposite lateral sides of the first magnetic column, respectively. The first winding set and the second winding set are respectively made by a flat conductive body in flatwise winding on the first magnetic column, and spaced apart with each other at a distance. The first winding set includes a first horizontal portion and two first conducting portions, and the two first conducting portions are connected to each other through the first horizontal portion. The second winding set includes a second horizontal portion and two second conducting portions, and the two second conducting portions are connected to each other through the second horizontal portion. The first horizontal portion and the second horizontal portion are at least partially exposed to the first side. The two first conducting portions are extended to the second side to form a first connection terminal and a second connection terminal of the first winding set, and the two second conducting portions are extended to the second side to form a first connection terminal and a second connection terminal of the second winding set, respectively. The first connection terminal of the first winding set is connected to the first switch unit and the first connection terminal of the second winding set is connected to the second switch unit. When a first current flows through the second winding set from the first connection terminal to the second connection terminal and a second current flows through the first winding set from the first connection terminal to the second connection terminal, respectively, two magnetic fluxes are generated to have directions opposite to each other in the first magnetic column. Wherein a connection point of the second connection terminal of the first winding set and the second connection terminal of the second winding set is served as an output terminal of the power module, respectively.

In accordance with a further aspect of the present disclosure, a power module is provided. The power module includes a magnetic component, a first switch unit and a second switch unit. The magnetic component includes a magnetic core, a first winding set and a second winding set. The magnetic core includes a first magnetic column, a second magnetic column, a third magnetic column, a first connecting portion, a second connecting portion and a third connecting portion. The first connecting portion and the second connecting portion are connected with each other through the first magnetic column, the second magnetic column and the third magnetic column to form a first side and a second side. The first side and the second side are opposite to each other. The first magnetic column is located between the second magnetic column and the third magnetic column, and the third connecting portion is located between the first connecting portion and the second connecting portion. The third connecting portion has a relative permeability lower than that of each of the first magnetic column, the second magnetic column, the third magnetic column, the first connecting portion and the second connecting portion. The first winding set and the second winding set are disposed on the first magnetic column of the magnetic core, and spaced apart by the third connecting portion. The first winding set includes a first horizontal portion and two first conducting portions, and the two first conducting portions are connected to each other through the first horizontal portion. The second winding set includes a second horizontal portion and two second conducting portions, and the two second conducting portions are connected to each other through the second horizontal portion. The first horizontal portion and the second horizontal portion are at least partially exposed to the first side, and the two first conducting portions and the two second conducting portions are extended to the second side. The first winding set and the second winding set are made by a flat conductive body, respectively. A first connection terminal of the first winding set is connected to the first switch unit, and a first connection terminal of the second winding set is connected to the second switch unit. When a first current flows through the second winding set from the first connection terminal to a second connection terminal and a second current flows through the first winding set from the first connection terminal to a second connection terminal, respectively, two magnetic fluxes are generated to have directions opposite to each other in the first magnetic column. Wherein a connection point of the second connection terminal of the first winding set and the second connection terminal of the second winding set is served as an output terminal of the power module.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
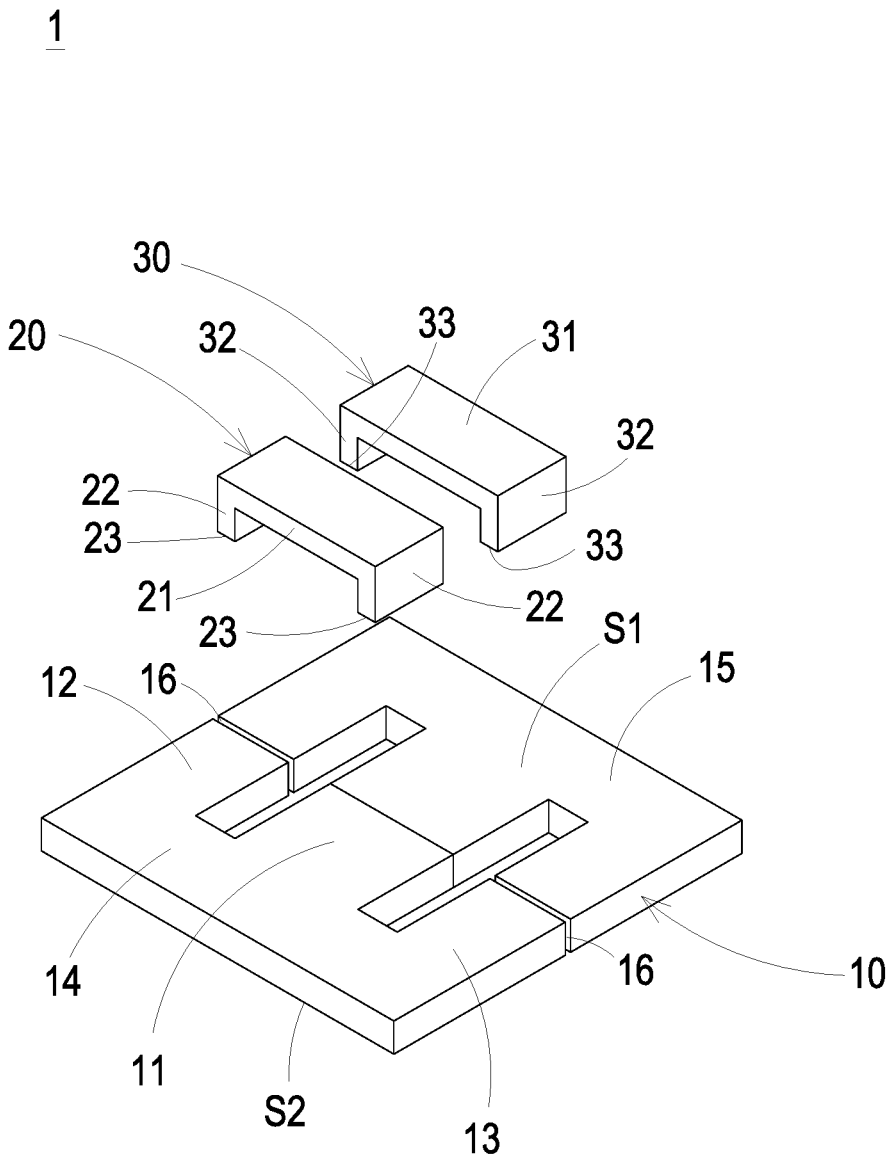
FIG. 1 is an exploded view illustrating a magnetic component according to a first embodiment of the present disclosure.
Figure 2A:
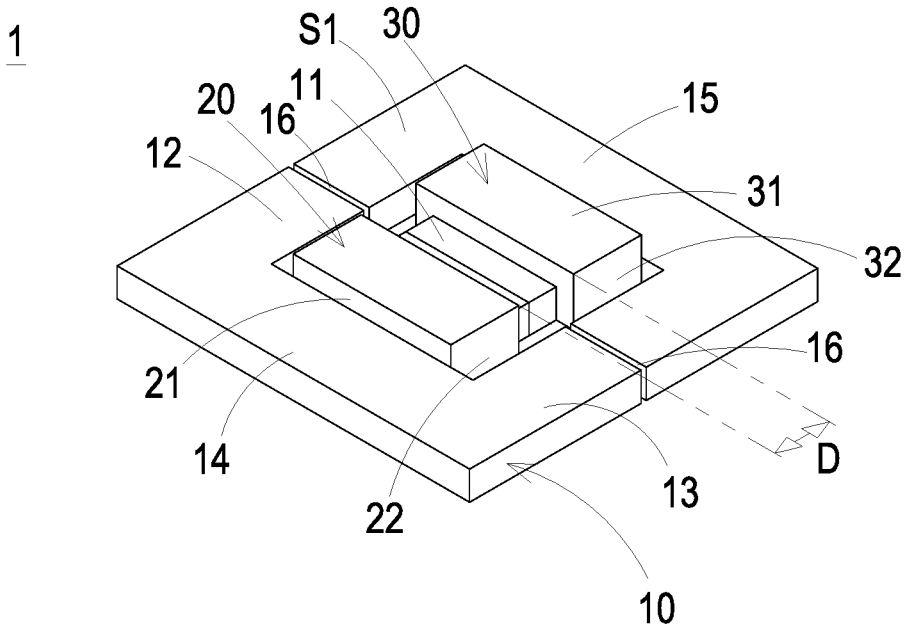
FIG. 2A is a schematic view illustrating the assembled magnetic component of FIG. 1.
Figure 2B:
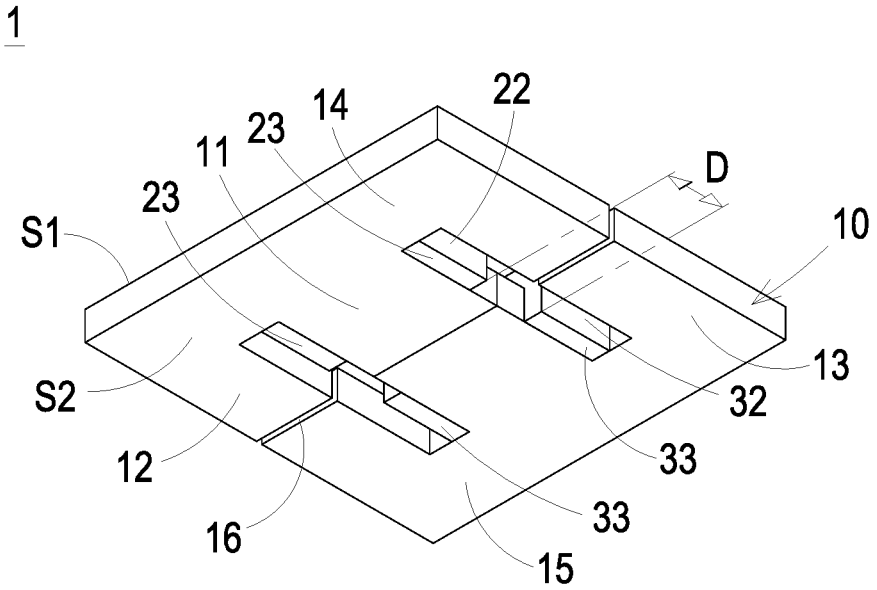
FIG. 2B is another schematic view illustrating the assembled magnetic component of FIG. 1 and taken from another perspective.
Figure 7:
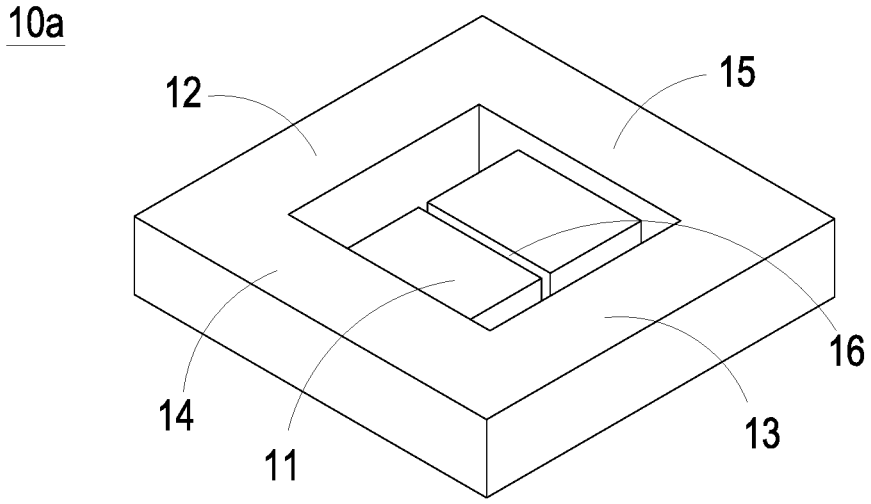
FIG. 7 is a second exemplary structure illustrating the magnetic core of the magnetic component of the present disclosure.

FIG. 1 is an exploded view illustrating a magnetic component according to a first embodiment of the present disclosure. FIGS. 2A and 2B are schematic views illustrating the assembled magnetic component of FIG. 1. As shown in FIG. 1 and FIGS. 2A to 2B, the magnetic component 1 includes a magnetic core 10, a first winding set 20 and a second winding set 30. The magnetic core 10 includes a first magnetic column 11, a second magnetic column 12, a third magnetic column 13, a first connecting portion 14 and a second connecting portion 15, which are connected with each other and form at least one air gap 16, a first side S1 and a second side S2. The first side S1 and the second side S2 are opposite to each other. In the embodiment, the first connecting portion 14 and the second connecting portion 15 are connected with each other through the first magnetic column 11, the second magnetic column 12 and the third magnetic column 13. Moreover, the first magnetic column 11 is located between the second magnetic column 12 and the third magnetic column 13. Preferably but not exclusively, the magnetic core 10 can be formed, for example, by EE type magnetic cores, EI type magnetic cores or a plurality of sub magnetic cores in combination. Alternatively, the magnetic core 10 can be a monolithic magnetic core, and the present disclosure is not limited thereto. In the embodiment, the air gap 16 has a function to adjust the amount of the main magnetic flux (mutual inductance magnetic flux) and prevents from the magnetic saturation. Preferably but not exclusively, the air gap 16 is disposed on the first magnetic column 11. Alternatively, two air gaps 16 are disposed on the second magnetic column 12 and the third magnetic column 13. The present disclosure is not limited thereto. In other embodiment, the magnetic core 10 can be for example a monolithic magnetic core, as shown in FIG. 7, and the air gap 16 is formed by cutting, but not limited thereto. The monolithic magnetic core can avoid the tolerance caused by assembling the magnetic core, thereby improving the dimensional accuracy and benefiting to reduce the inductor height. In the embodiment, the first winding set 20 and the second winding set 30 are disposed on the first magnetic column 11 of the magnetic core 10 and spaced apart with each other at a distance D. The first winding set 20 and the second winding set 30 are free of overlapping the at least one air gap 16. Namely, the first winding set 20 and the second winding set 30 are misaligned with the at least one air gap 16. The first winding set 20 includes a first horizontal portion 21 and two first conducting portions 22, and the two first conducting portions 22 are connected to each other through the first horizontal portion 21. In addition, the second winding set 30 includes a second horizontal portion 31 and two second conducting portions 32, and the two second conducting portions 32 are connected to each other through the second horizontal portion 31. The direction of the axis of the first magnetic column 11 is referred to a width direction of an inductor. In the embodiment, the first horizontal portion 21 and the second horizontal portion 31 are at least partially exposed on the first side S1. The two first conducting portions 22 and the two second conducting portions 32 are extended to the second side S2 to form connection terminals 23 of the first winding set 20 and connection terminals 33 of the second winding set 30, respectively. Namely, the connection terminals 23 of the first winding set 20 and the connection terminals 33 of the second winding set 30 are configured to form for example, four surface mounting pads or four straight pins of the magnetic component 1. The structure benefits to greatly reduce the thermal resistance of the inductor in the height direction. In the application of such thin inductor, the main channel of heat dissipation is generally located in the height direction, and one end of the winding set is often connected to a main heat source, such as a semiconductor device. Comparing with the magnetic core material, the thermal conductivity of the copper is better. Since a conductive part of the winding set is directly exposed on the first side S1 and the second side S2, the heat can be directly transferred from the second side S2 to the first side S1 through the conductive part of the winding set. The first side S1 of the magnetic component 1 may further connect a heat sink. It benefits to substantially improve the heat dissipation capability of the inductor in the height direction. Moreover, since the first winding set 20 and the second winding set 30 are disposed on the first magnetic column 11, respectively, and spaced apart with each other at the distance D along the width direction, the leakage inductance of the coupled inductor can be controlled by adjusting the length of the interval distance D. Namely, the amount of the leakage flux can be controlled by adjusting the length of the interval distance D. In the embodiment, the cross section of the first winding set 20 and the cross section of the second winding set 30 are a rectangular cross section, respectively. Preferably but not exclusively, a flat wire is formed on the first magnetic column 11 in a winding manner to facilitate the inductor to reduce the entire height thereof, but the present disclosure is not limited thereto. The so-called flatwise winding is another method of winding the flat wire, compared to the edgewise winding. The flatwise winding means that the long-side direction of the cross section of the flat wire is approximately parallel to the magnetic flux direction of the wound magnetic column. The edgewise winding means that the short-side direction of the cross section of the flat wire is parallel or approximately parallel to the magnetic flux direction of the wound magnetic column. Moreover, in the embodiment, the first winding set 20 and the second winding set 30 can be for example prefabricated and made by a flat conductive body, respectively, and then assembled on the first magnetic column 11 of the magnetic core 10. It benefits to avoid the risk of bending the first winding set 20 and the second winding set 30 after assembling to damage the magnetic core 10. It should be noted that the first winding set 20 and the second winding set 30 can be formed by bending a flat wire or by sheet metal process. In the embodiment, the height of the magnetic component 1 can be for example less than 6 mm and the thickness of the first winding set 20 and the thickness of the second winding set 30 are thicker than 0.2 mm. Since the conductive cross-sectional area is large and the DC resistance is small, it benefits to reduce the copper loss of the inductor. In high-current VRM applications, this part of the loss is even a major part of the total loss of the inductor. Thicker winding set is beneficial to achieve a lower thermal resistance in the direction of height. In addition, the thicker winding set can also provide the sufficient strength in the structure to facilitate the fabrication of the magnetic component 1.

In the embodiment, the magnetic core 10 includes a pair of first air gaps 16 disposed on the second magnetic column 12 and the third magnetic column 13, respectively, to achieve a certain self-inductance and avoid the saturation. The first winding set 20 and the second winding set 30 are disposed on the first magnetic column 11 and the first air gaps 16 are disposed on the second magnetic column 12 and the third magnetic column 13. Since the first winding set 20, the second winding set 30 and the first air gaps 16 are disposed on different magnetic columns, the first winding set 20 and the second winding set 30 can be disposed closely on the first magnetic column 11 and there is no need to consider the fringing flux loss of the winding set caused by leakage flux of the first air gap 16. The currents in the first winding set 20 and the second winding set 30 form a magnetic flux, and the magnetic flux of the first winding set 20 and the second winding set 30 coupled with each other is a main magnetic flux, and the plane of the main magnetic flux is parallel to the plane formed by the connection terminals 23 of the first winding set 20 and the connection terminals 33 of the second winding set 30 on the second side S2. The inductor formed by the magnetic component 1 is projected on the second side S2 to form a centrosymmetric pattern. Since the first winding set 20, the second winding set 30 and the first air gaps 16 are centrally symmetrically distributed, it is advantageous to form the symmetric inductance of the two-phase inductor.

Figure 3A:
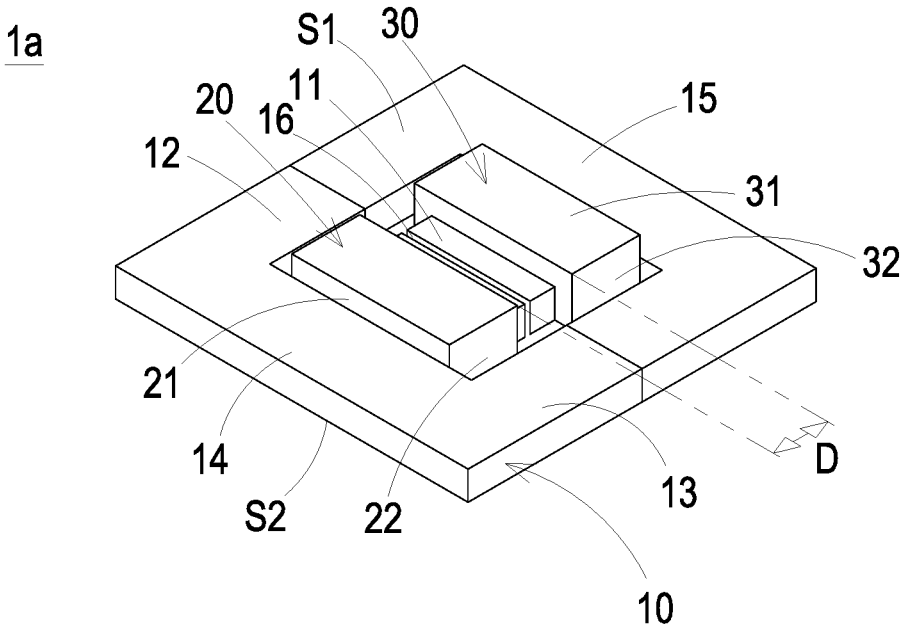
FIG. 3A is a schematic view illustrating a magnetic component according to a second embodiment of the present disclosure.
Figure 3B:
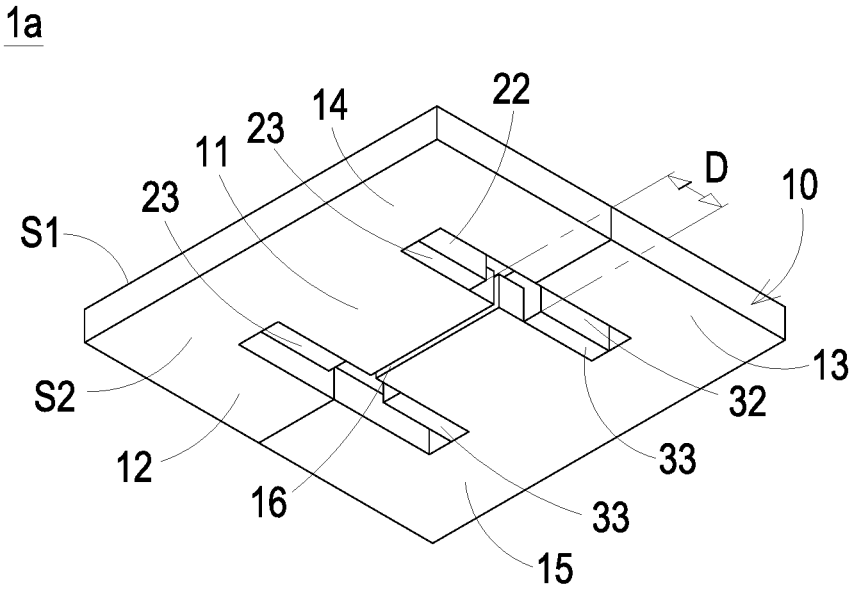
FIG. 3B is another schematic view illustrating the magnetic component according to the second embodiment of the present disclosure and taken from another perspective.

FIGS. 3A and 3B are schematic views illustrating a magnetic component according to a second embodiment of the present disclosure. In the embodiment, the structures, elements and functions of the magnetic component 1*a* are similar to those of the magnetic component 1 in FIGS. 1 and 2A to 2B, and are not redundantly described herein. In the embodiment, the magnetic core 10 includes a first air gap 16 located at the central position of the first magnetic column 11. The first winding set 20 and the second winding set 30 are located at two ends of the first magnetic column 11. The first winding set 20 and the second winding set 30 are free of overlapping the first air gap 16. Consequently, the first winding set 20 and the second winding set 30 are disposed closely on the first magnetic column 11. It is beneficial to reduce the overall height of the inductor. In addition, comparing with the magnetic component 1 having the first air gaps 16 disposed on the second magnetic column 12 and the third magnetic column 13, in the embodiment, the magnetic component la sets the first air gap 16 in the middle of the first magnetic column 11 so as to eliminate the fringing flux generated from the gap edges. In some applications, there will be conductive body such as heat sink (not shown) disposed above the inductor. When the inductor is soldered on the PCB, since the heat sink disposed above the inductor is usually made of a conductive material, such as aluminum or copper and the eddy current loss may be generated on the conductive body due to the fringing flux, the smaller fringing flux of the magnetic component 1*a* can reduce this type of loss. Furthermore, a smaller fringing flux is also beneficial in reducing electromagnetic interference.

Figure 4:
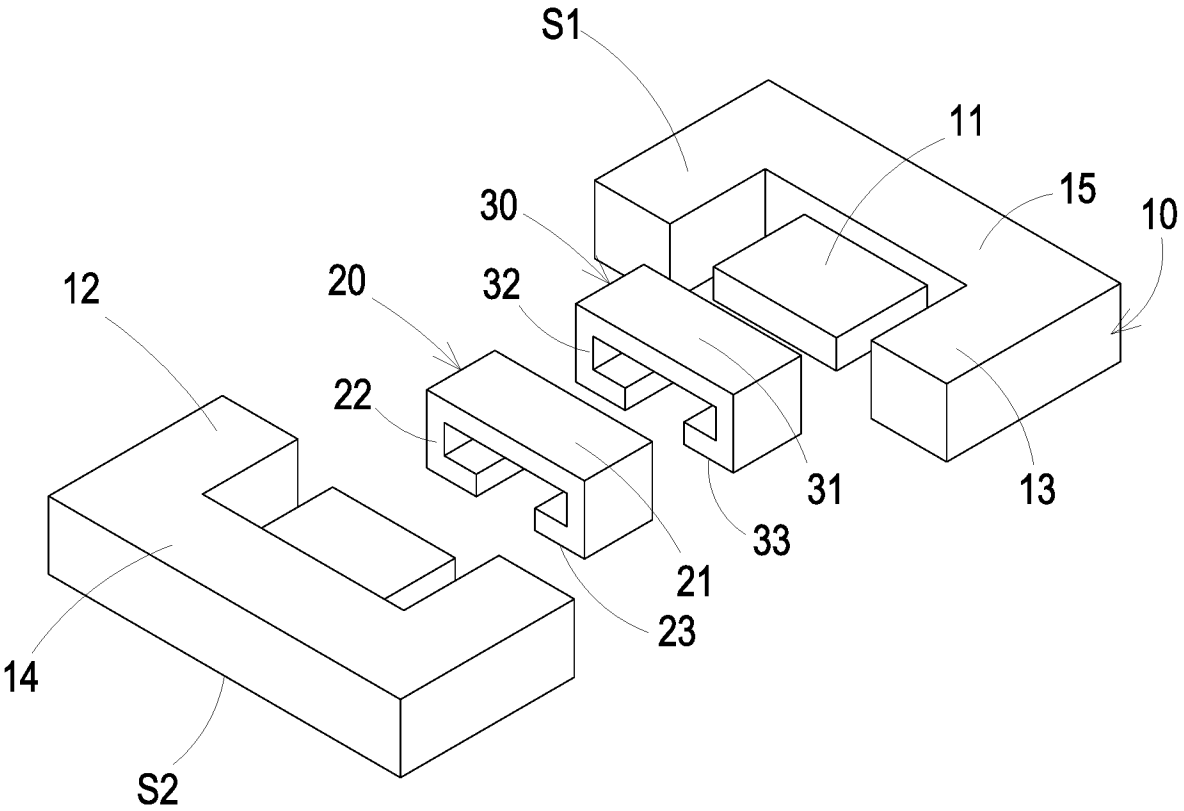
FIG. 4 is an exploded view illustrating a magnetic component according to a third embodiment of the present disclosure.
Figure 5A:
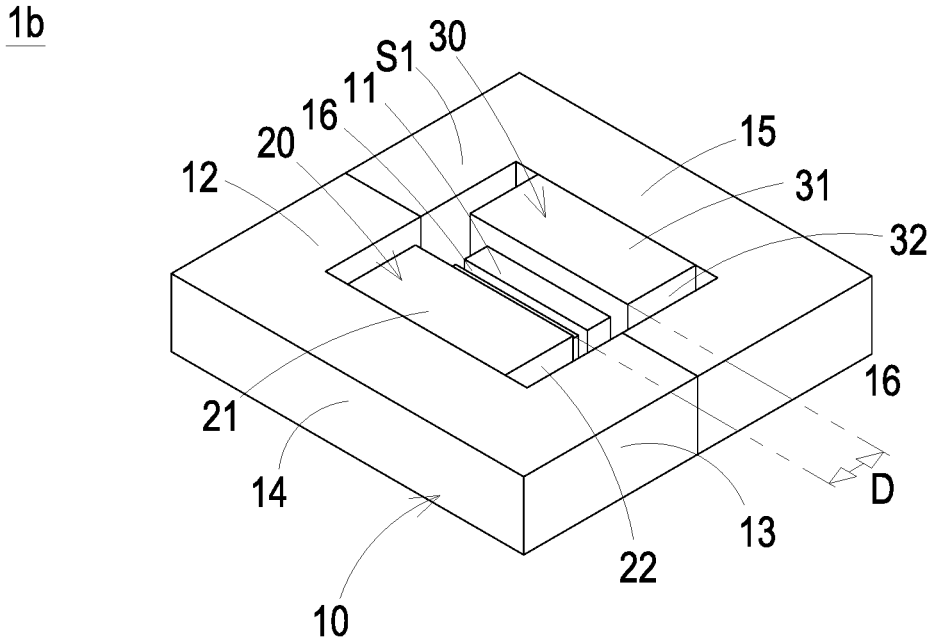
FIG. 5A is a schematic view illustrating the assembled magnetic component of FIG. 4.
Figure 5B:
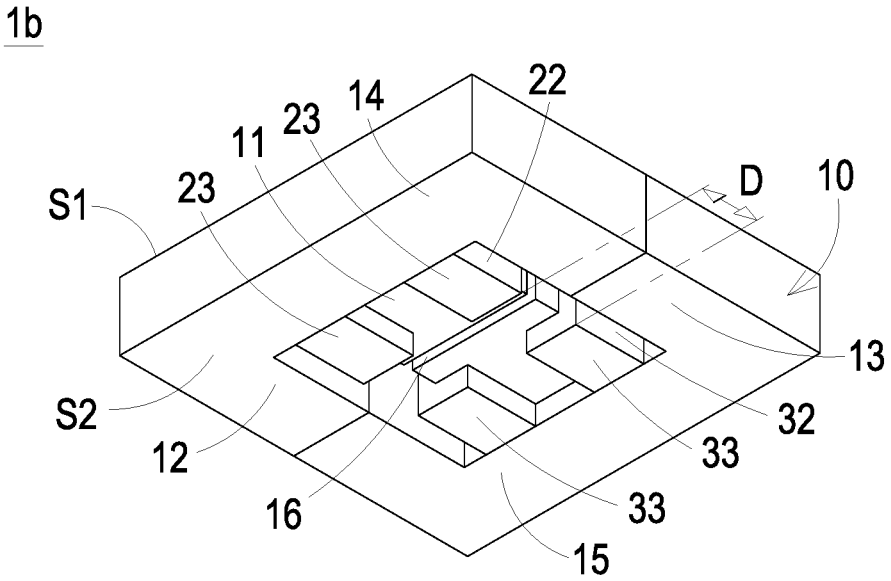
FIG. 5B is another schematic view illustrating the assembled magnetic component of FIG. 4 and taken from another perspective.
Figure 6:
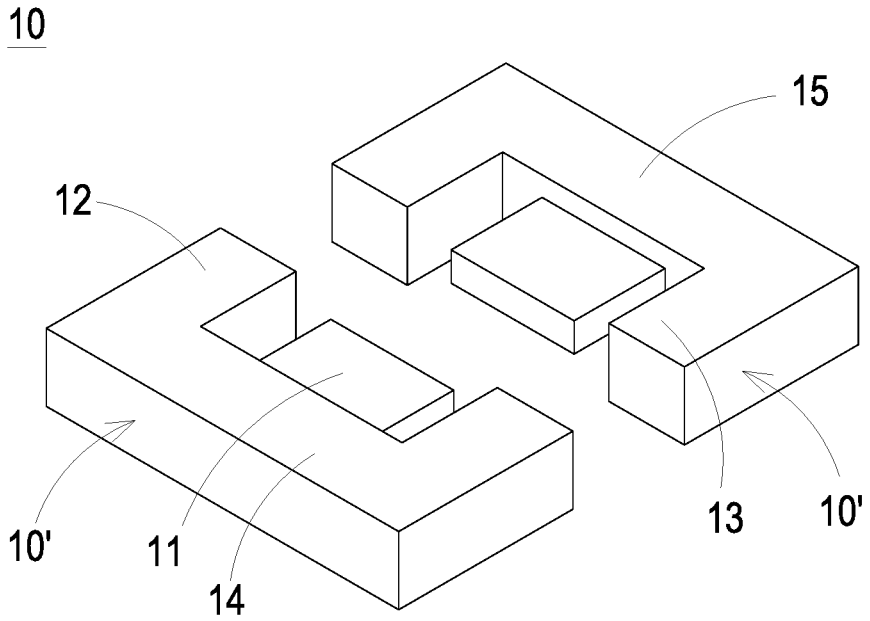
FIG. 6 is a first exemplary structure illustrating the magnetic core of the magnetic component of the present disclosure.

FIG. 4 is an exploded view illustrating a magnetic component according to a third embodiment of the present disclosure. FIGS. 5A and 5B are schematic views illustrating the assembled magnetic component of FIG. 4. In the embodiment, the structures, elements and functions of the magnetic component 1*b* are similar to those of the magnetic component 1*a* in FIGS. 3A and 3B, and are not redundantly described herein. In the embodiment, the thickness of the first magnetic column 11 is thinner than the thickness of the second magnetic column 12 and the thickness of the third magnetic column 13, and/or the thicknesses of the connecting portions 14 and 15. Thus, it is advantageous for the magnetic component 1*b* to further improve space utilization and reduce the entire height or the occupied area. In addition, the first horizontal portion 21 of the first winding set 20, the second horizontal portion 31 of the second winding set 30, the first connecting portion 14 and the second connecting portion 15 are coplanar on the first side S1 of the magnetic core 10, so that it facilitates to attach to for example a heat-dissipation device for heat dissipation. On the other hand, the two connection terminals 23 of the first winding set 20 and the two connection terminals 33 of the second winding set 30 are coplanar on the second side S2 of the magnetic core 10, so that if facilitates to attach to for example a circuit board for electrical connection, but the present disclosure is not limited thereto. Moreover, in the embodiment, as shown in FIG. 6, the magnetic core 10 is formed by assembling two E-shaped magnetic cores 10'. After assembling, the first air gap 16 is formed on the first magnetic column 11 (referred to FIG. 5A), but the present disclosure is not limited thereto. FIG. 7 is a second exemplary structure illustrating the magnetic core of the magnetic component of the present disclosure. The magnetic core 10*a* is a monolithic core made by a powder core material. The first air gap 16 is formed by cutting, but there is no air gap formed on the second magnetic column 12 and the third magnetic column 13. In another embodiment, the magnetic core 10*a* is made by the powder core material without forming an air gap. The present disclosure is not limited thereto. The monolithic magnetic core 10*a* is beneficial to eliminate the tolerance caused by assembling the magnetic core, thereby improving the dimensional accuracy. In the embodiment, the magnetic component 1*b* is for example a two-phase coupled inductor. The connection terminals 23 of the first winding set 20 and the connection terminals 33 of the second winding set 30 are bent toward the center of the first magnetic column 11, to form four surface mounting pads of the magnetic component 1*b*.

Figure 8A:
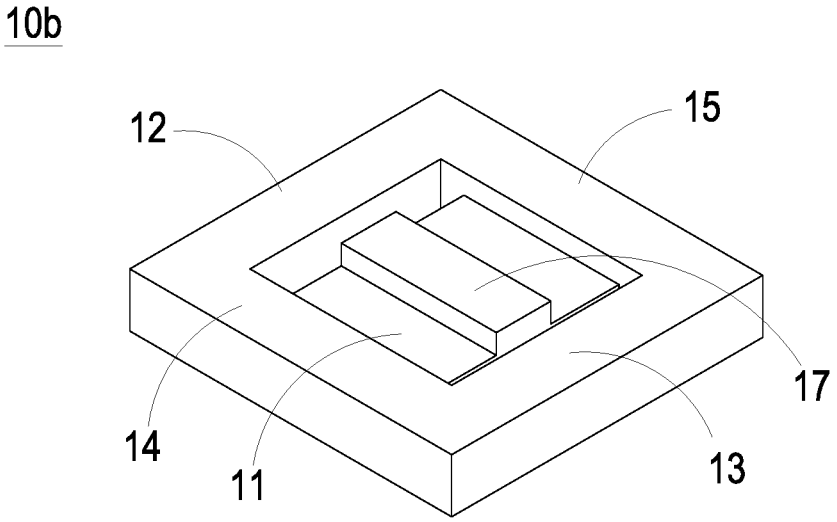
FIG. 8A is a third exemplary structure illustrating the magnetic core of the magnetic component of the present disclosure.
Figure 8B:
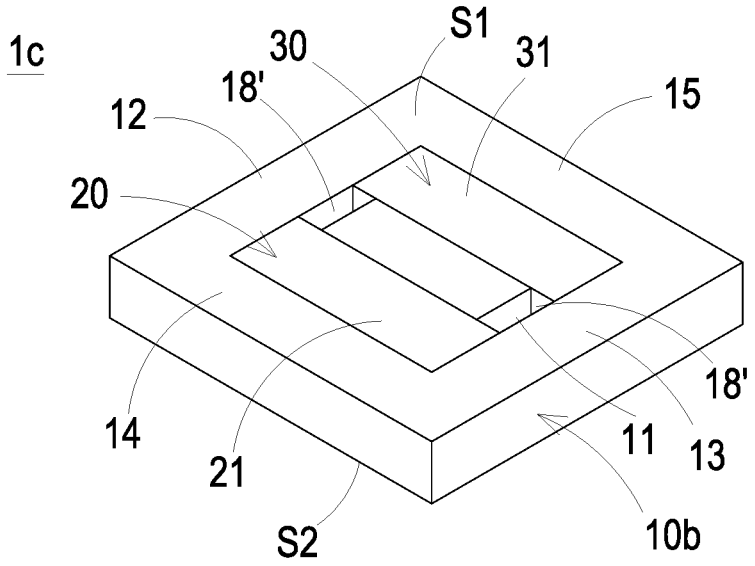
FIG. 8B is a schematic view illustrating a magnetic component according to a fourth embodiment of the present disclosure.

Moreover, in order to facilitate the disposition of the first winding set 20 and the second winding set 30, the first magnetic column 11 further includes a limitation structure. FIG. 8A is a third exemplary structure illustrating the magnetic core of the magnetic component of the present disclosure. FIG. 8B is a schematic view illustrating a magnetic component according to a fourth embodiment of the present disclosure. In the embodiment, the structures, elements and functions of the magnetic component 1*c* are similar to those of the magnetic component 1*b* in FIGS. 5A and 5B, and are not redundantly described herein. In the embodiment, the magnetic core 10*b* includes a first magnetic column 11, a second magnetic column 12, a third magnetic column 13, a first connecting portion 14 and a second connecting portion 15 integrally formed into one piece. The monolithic magnetic core 10*b* further includes a first limitation part 17. The first limitation part 17 is disposed on the first magnetic column 11 and located between the first horizontal portion 21 of the first winding set 20 and the second horizontal portion 31 of the second winding set 30. In addition, the first limitation part 17, the first horizontal portion 21 of the first winding set 20, the second horizontal portion 31 of the second winding set 30, the first connecting portion 14 and the second connecting portion 15 are coplanar on the first side S1 of the magnetic core 10*b*, so as to facilitate the magnetic components 1*c* to maintain the flatness of the entire structure. The material of the first limitation part 17 and the material of the magnetic core 10*b* can be similar or not. In the embodiment, the first limitation part 17 is made by the same powder core material of the magnetic core 10*b*, so as to improve the magnetic performance. It is noted that the powder core material of the magnetic core 10*b* may be the alloy magnetic powder having a surface coating of the insulated layer and mixed with a certain proportion of glue. Comparing with the ferrite material, the alloy powder core material has a low magnetic permeability, and generally has a relative permeability value ranged from 5 to 100. Thus, the first magnetic column 11, the second magnetic column 12, the third magnetic column 13, the first connecting portion 14 and the second connecting portion 15 are provided without an air gap, and the magnetic core 10*b* is a monolithic core, as shown in FIG. 8A. The magnetic core 10*b* is provided without an air gap, and the fringing flux of the air gap can be eliminated, thereby reducing the eddy current loss of the winding set and reducing the leakage flux of the inductor. On the other hand, the saturation flux density of the powder core material is higher than that of the ferrite material. The saturation magnetic flux density of the ferrite material is generally ranged from 0.2 tesla (T) to 0.5 tesla (T), and the saturation magnetic flux density of the powder core material is usually ranged from 0.8 tesla (T) to 1.5 tesla (T). Since the higher saturation flux density is beneficial to greatly reduce the volume of the inductor, it is particularly suitable for applications where the size requirement is critical. Moreover, the alloy powder core material needn't to be sintered at a high temperature, and can be formed by curing, for example, at about 200 degrees Celsius (° C.). Therefore, the magnetic core 10*b* can be pressed together with the conductive body to form a monolithic inductor. The advantage is remarkable in miniaturization.

Figure 9A:
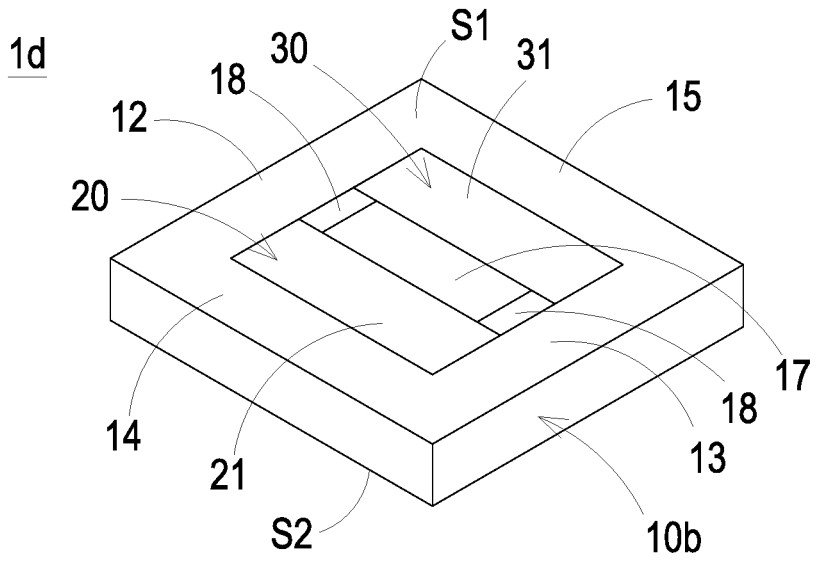
FIG. 9A is a schematic view illustrating a magnetic component according to a fifth embodiment of the present disclosure.
Figure 9B:
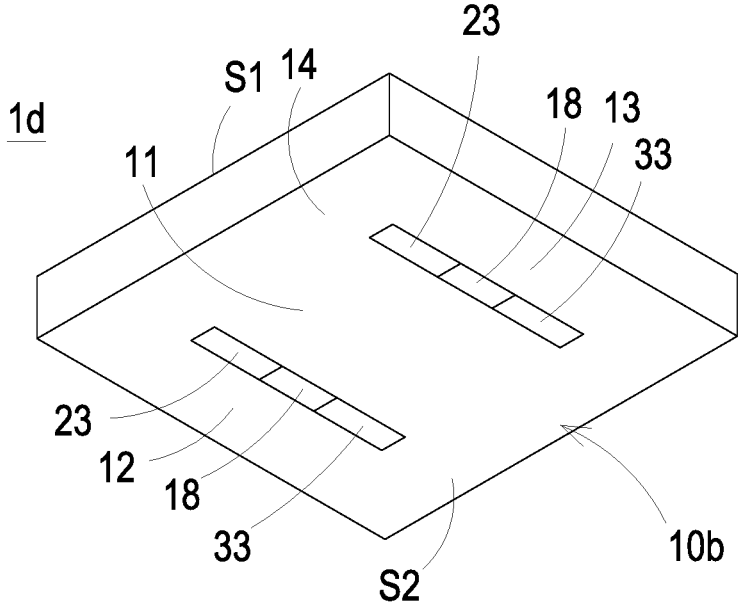
FIG. 9B is another schematic view illustrating the magnetic component according to the fifth embodiment of the present disclosure and taken from another perspective.

FIGS. 9A and 9B are schematic views illustrating a magnetic component according to a fifth embodiment of the present disclosure. In the embodiment, the structures, elements and functions of the magnetic component 1*d* are similar to those of the magnetic component 1*c* in FIG. 8B, and are not redundantly described herein. In the embodiment, the magnetic component 1*d* further includes at least one third connecting portion 18 disposed between the corresponding first winding set 20 and the corresponding second winding set 30, to increase the bonding strength among the first winding set 20, the second winding set 30 and the magnetic core 10*b*. In the embodiment, two third connecting portions 18 are respectively disposed within two chambers 18' (referred to FIG. 8B) defined and surrounded by the first magnetic column 11, the second magnetic column 12, the third magnetic column 18, the first winding set 20 and the second winding set 30. In the embodiment, the third connecting portions 18 are exposed on the first side S1 and the second side S2 of the magnetic core 10*b*. Namely, the first limitation part 17, the two third connecting portions 18, the first horizontal portion 21 of the first winding set 20, the second horizontal portion 31 of the second winding set 30, the first connecting portion 14 and the second connecting portion 15 are coplanar on the first side S1 of the magnetic core 10*b*. Moreover, the two third connecting portions 18, the two connection terminals 23 of the first winding set 20 and the two connection terminals 33 of the second winding set 30 are coplanar on the second side S2 of the magnetic core 10*b*, to achieve the flatness of the entire structure of the magnetic component 1*d*. On the other hand, the third connecting portions 18 further provide the function of adjusting the inductive coupling coefficient. In the embodiment, the third connecting portions 18 can be formed, for example, by a non-magnetic material such as an epoxy resin to achieve a better coupling between the first winding set 20 and the second winding set 30. In another embodiment, the third connecting portions 18 can be formed, for example, by a magnetic material, to increase the leakage inductance and reduce the coupling coefficient. In the embodiment, the third connecting portion 18 are made by a material having a relative permeability lower than that of the powder core material of the magnetic core 10*b*, but the present disclosure is not limited thereto.

Figure 10A:
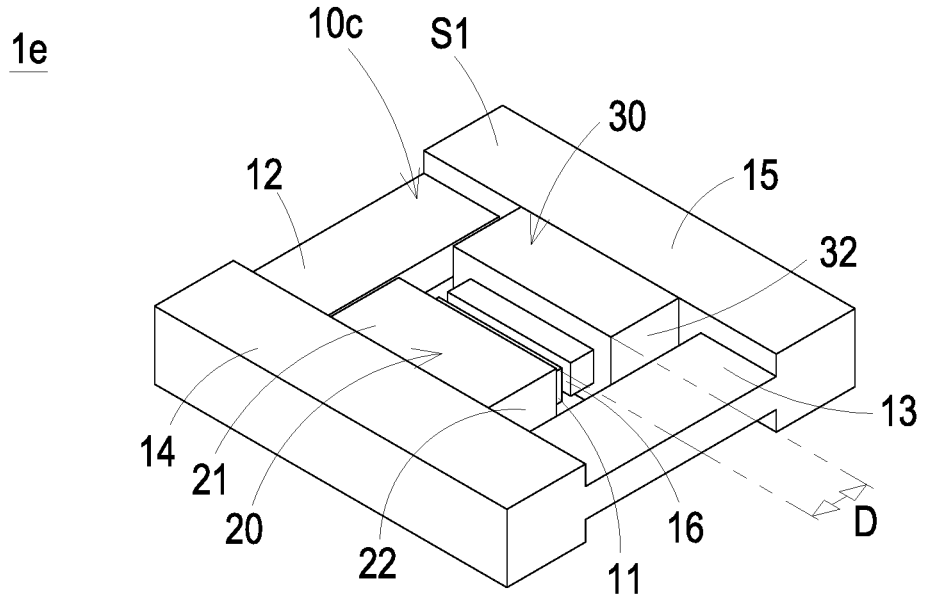
FIG. 10A is a schematic view illustrating a magnetic component according to a sixth embodiment of the present disclosure.
Figure 10B:
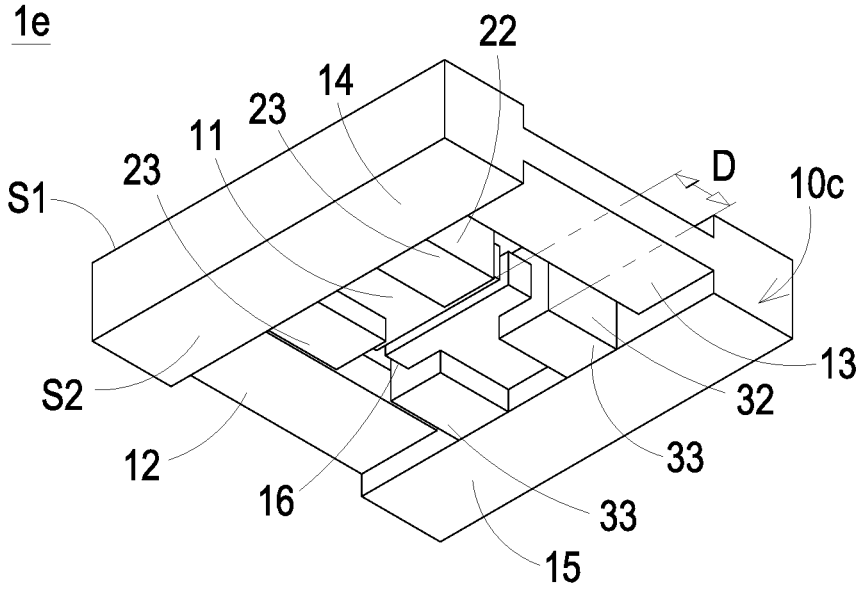
FIG. 10B is another schematic view illustrating the magnetic component according to the sixth embodiment of the present disclosure and taken from another perspective.

FIGS. 10A and 10B are schematic views illustrating a magnetic component according to a sixth embodiment of the present disclosure. In the embodiment, the structures, elements and functions of the magnetic component 1*e* are similar to those of the magnetic component 1*b* in FIGS. 5A and 5B, and are not redundantly described herein. In the embodiment, the magnetic core 10*c* of the magnetic component 1*e* can be a monolithic core made by for example a powder core material and includes a first magnetic column 11, a second magnetic column 12, a third magnetic column 13, a first connecting portion 14 and a second connecting portion 15. The first horizontal portion 21 of the first winding set 20, the second horizontal portion 31 of the second winding set 30, the first connecting portion 14 and the second connecting portion 15 are coplanar on the first side S1 of the magnetic core 10*c*. The two connection terminals 23 of the first winding set 20 and the two connection terminals 33 of the second winding set 30 are coplanar on the second side S2 of the magnetic core 10*c*. Thus, the first connecting portion 14 and the second connecting portion 15 can provide the magnetic component 1*e* with sufficient structural support strength. Furthermore, as shown in FIGS. 8A to 9B, the first limitation part 17 and/or the third connecting portions 18 can be disposed to be coplanar with the other components on the first side S1 and/or the second side S2. The thicknesses of the first magnetic column 11, the second magnetic column 12 and the third magnetic column 13 are thinner than the thicknesses of the first connecting portion 14 and the second connecting portion 15, respectively, to facilitate the weight reduction of the magnetic component 1*e*. In an embodiment, a first air gap 16 is disposed on the first magnetic column 11, but there is no air gap formed on the second magnetic column 12 and the third magnetic column 13. Alternatively, the first air gaps 16 are disposed on the second magnetic column 12 and the third magnetic column 13, but there is no air gap formed on the first magnetic column 11. In the embodiment, the height of the magnetic component 1*e* can be for example less than 6 mm and the thickness of the first winding set 20 and the thickness of the second winding set 30 are thicker than 0.2 mm. In addition, the cross section of the first winding set 20 and the cross section of the second winding set 30 are a rectangular cross section, respectively. Preferably but not exclusively, a flat wire is formed on the first magnetic column 11 in a winding manner to facilitate the inductor to reduce the entire height thereof. Certainly, the present disclosure is not limited thereto.

Figure 11A:
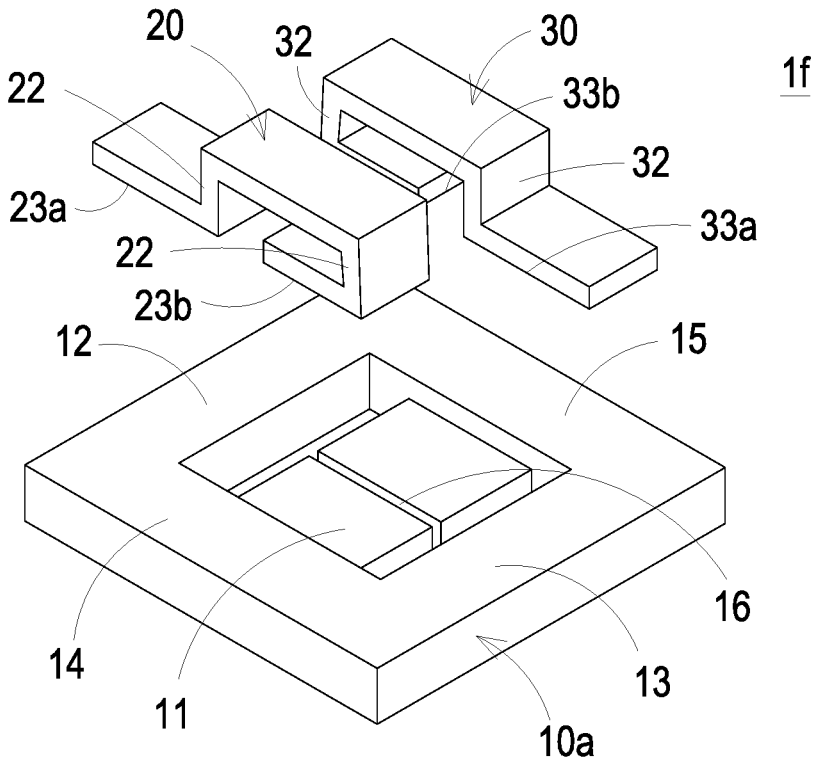
FIG. 11A is an exploded view illustrating the magnetic component according to a seventh embodiment of the present disclosure.
Figure 11B:
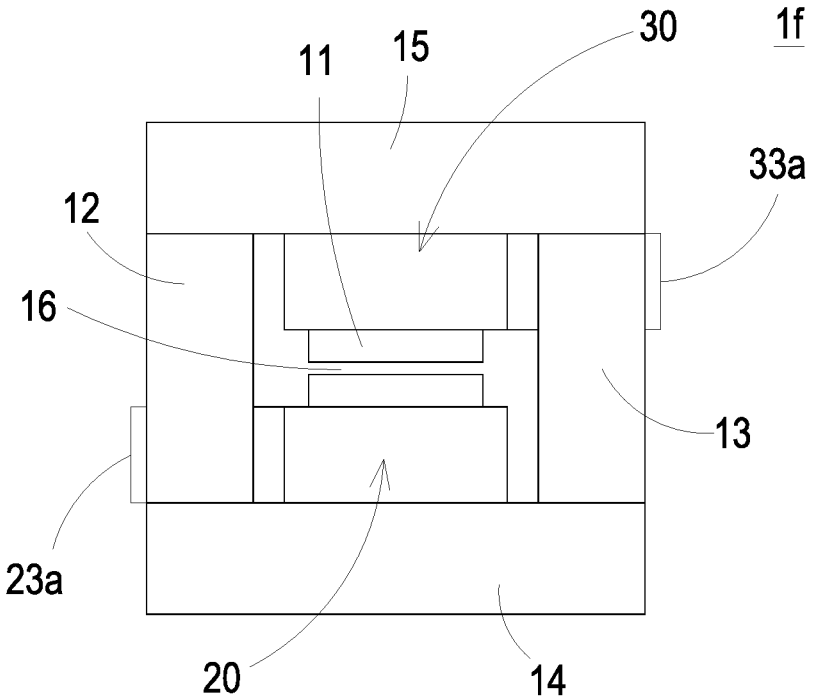
FIG. 11B is a top view illustrating the magnetic component according to the seventh embodiment of the present disclosure.
Figure 12A:
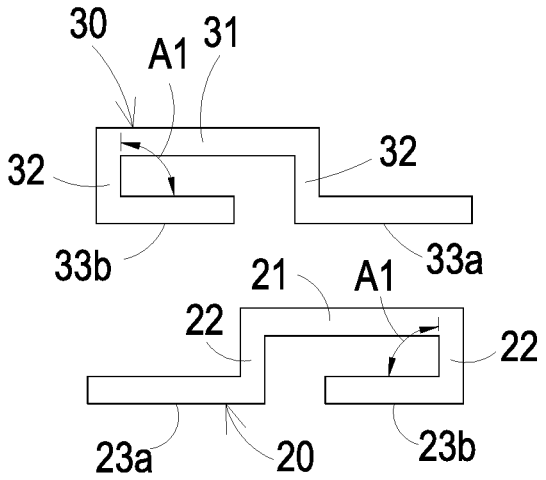
FIG. 12A is a lateral view illustrating the winding sets of the magnetic component according to an exemplary embodiment of the present disclosure.
Figure 12B:
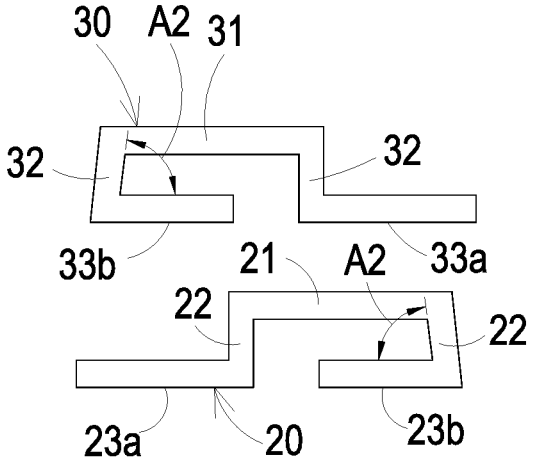
FIG. 12B is a lateral view illustrating the winding sets of the magnetic component according to another exemplary embodiment of the present disclosure.

FIG. 11A is an exploded view illustrating the magnetic component according to a seventh embodiment of the present disclosure. FIG. 11B is a top view illustrating the magnetic component according to the seventh embodiment of the present disclosure. FIG. 12A is a lateral view illustrating the winding sets of the magnetic component according to an exemplary embodiment of the present disclosure. FIG. 12B is a lateral view illustrating the winding sets of the magnetic component according to another exemplary embodiment of the present disclosure. In the embodiment, the structures, elements and functions of the magnetic component 1*f* are similar to those of the magnetic component 1*b* in FIGS. 5A and 5B, and are not redundantly described herein. In the embodiment, the magnetic component 1*f* is, for example, a two-phase coupled inductor. As shown in FIGS. 11A and 11B, the connection terminal 23*a* of the first winding set 20 and the connection terminal 33*a* of the second winding set 30 are bent away from the center of the first magnetic column 11, to form the surface mounting pads, respectively. The connection terminal 23*a* of the first winding set 20 is bent toward the second magnetic column 12, to form the surface mounting pad located under the second magnetic column 12. The connection terminal 33*a* of the second winding set 30 is bent toward the third magnetic column 13, to form the surface mounting pad located under the third magnetic column 13. In addition, the connection terminal 23*b* of the first winding set 20 and the connection terminal 33*b* of the second winding set 30 of the first magnetic component 1*f* are bent toward the center of the first magnetic column 11, to form the surface mounting pads of the magnetic component 1*f*, respectively. In the embodiment, the connection terminals 23*a*, 23*b*, 33*a* and 33*b* are coplanar on the second side S2 of the magnetic core 10*a*.

In the embodiment, the first winding set 20 and the second winding set 30 are prefabricated. After the first horizontal portion 21 and the two first conducting portions 22 are formed in a U shape, the two connection terminals 23*a* and 23*b* are further formed by bending. Similarly, the second horizontal portion 31 and the two second conducting portions 32 are bent to form a U shape, and then the two connection terminals 33*a* and 33*b* are further formed by bending. The prefabricated first winding set 20 and the prefabricated second winding set 30 are assembled with the magnetic core 10*a* so as to form the magnetic component 1*f*. Since the thickness of the magnetic core 10*a* is very thin, it is often difficult to make a bevel on the first magnetic column 11. In order to facilitate the first winding set 20 and the second winding set 30 to assemble with the first magnetic column 11 easily, in an embodiment, the first conducting portion 22 and the connection terminal 23*b* of the first winding set 20 form an angle A1, and the second conducting portion 32 and the connection terminal 33*b* of the second winding set 30 form an angle A1. The angle A1 can be, for example, 90 degrees, as shown in FIG. 12A. In another embodiment, the first conducting portion 22 and the connection terminal 23*b* of the first winding set 20 form an angle A2, and the second conducting portion 32 and the connection terminal 33*b* of the second winding set 30 form an angle A2. The angle A2 can be, for example, less than 90 degrees, as shown in FIG. 12B. Consequently, the position of the connection terminal 23*b* relative to the first conducting portion 22 and the position of the connection terminal 33*b* relative to the second conducting portion 32 are not easily interfered with the first magnetic column 11, the connection terminals 23*a* and 23*b* of the first winding set 20 and the connection terminals 33*a* and 33*b* of the second winding set 30 are coplanar. The first winding set 20 and the second winding set 30 of the embodiment can be implemented in other embodiments, and the present disclosure is not limited thereto.

Figure 13:
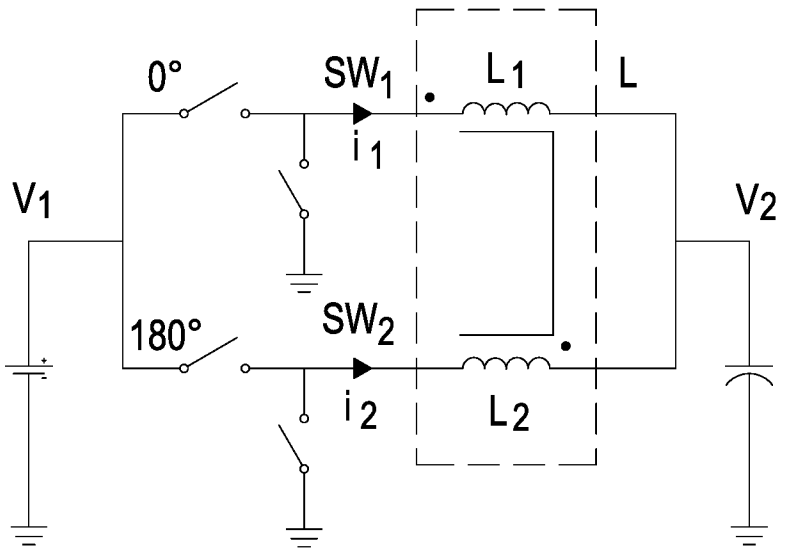
FIG. 13 is an exemplary circuit diagram showing the magnetic component of the present disclosure applied to a two-phase voltage regulator module.
Figure 14A:
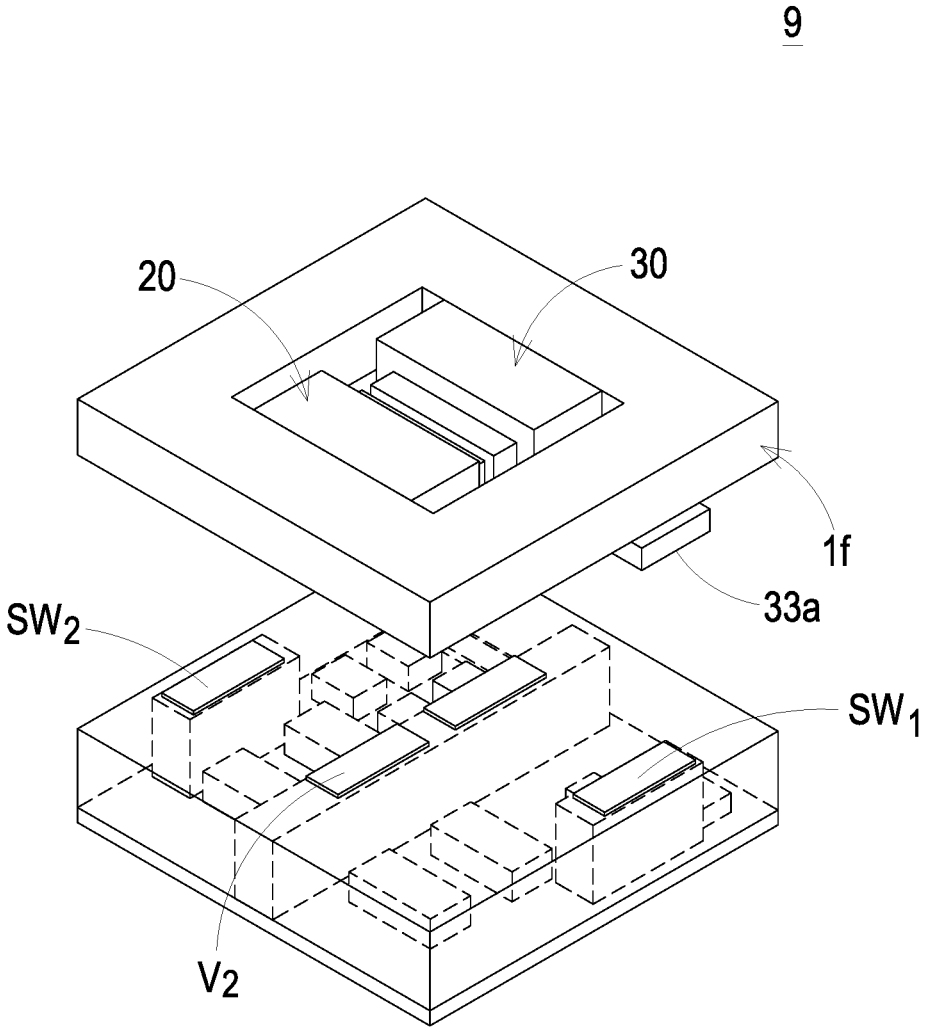
FIG. 14A is a schematic view illustrating the magnetic component of FIG. 11A applied to the two-phase voltage regulator module.
Figure 14B:
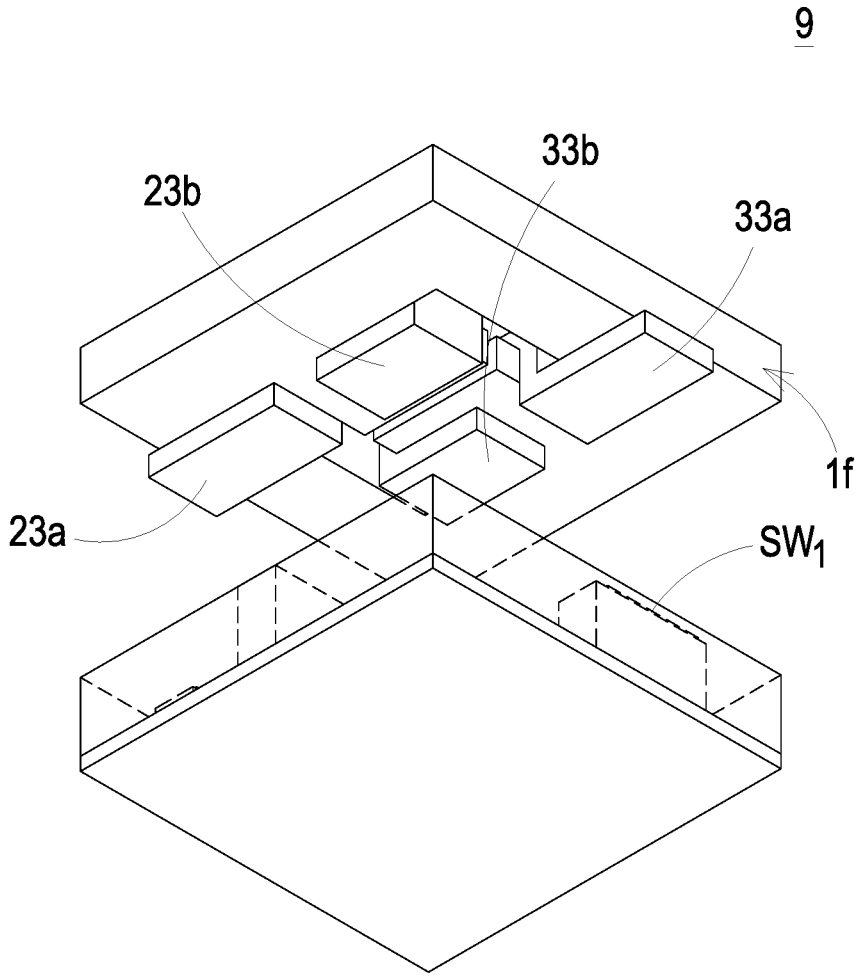
FIG. 14B is another schematic view illustrating the magnetic component of FIG. 11A applied to the two-phase voltage regulator module and taken from another perspective.
Figure 15:
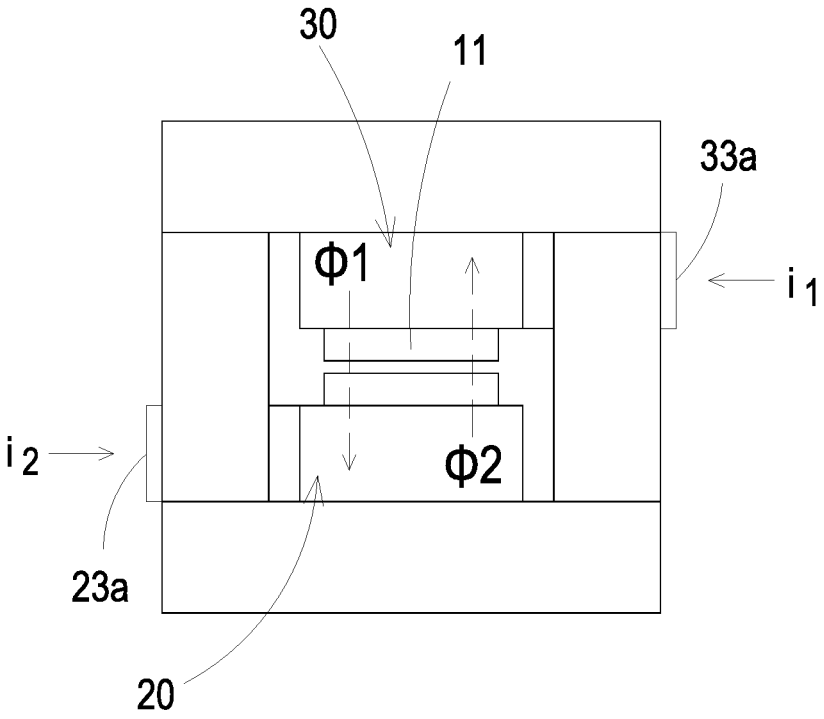
FIG. 15 is a diagram showing the magnetic flux generated by the two-phase coupled inductor when the two-phase voltage regulator module of FIG. 14A is energized.

FIG. 13 is an exemplary circuit diagram showing the magnetic component of the present disclosure applied to a two-phase voltage regulator module. FIGS. 14A and 14B are schematic views illustrating the magnetic component of FIG. 11A applied to the two-phase voltage regulator module. FIG. 15 is a diagram showing the magnetic flux generated by the two-phase coupled inductor. As shown in FIGS. 13 to 15, the two-phase voltage regulator module 9 (hereinafter referred to as VRM 9) converts the input voltage $V_1$ to the output voltage $V_2$ so as to power the load. In order to achieve a larger output current, the VRM 9 is implemented by connecting two phases in parallel. The VRM 9 includes two switch units and a two-phase coupled-inductor module L. The coupled-inductor module L is constructed by the magnetic component 1*f*, which includes four connection terminals 23*a*, 23*b*, 33*a* and 33*b*. The first connection terminal 33*a* of the second winding set 30 is connected to a terminal $SW_1$ of a first switch unit to serve as the inductor $L_1$. The first connection terminal 23*a* of the first winding set 20 is connected to a terminal $SW_2$ of a second switch unit to serve as the inductor $L_2$. The second connection terminal 23*b* of the first winding set 20 and the second connection terminal 33*b* of the second winding set 30 are directly connected together, so that a connection point of the second connection terminal 23*b* of the first winding set 20 and the second connection terminal 33*b* of the second winding set 30 is served as an output terminal $V_2$ of the entire VRM 9. In order to achieve lower output ripple, the different phases may be operated with a phase difference, which is commonly referred to as an interleaving operation. As shown in FIG. 13, the two phases may differ from each other by 180 degrees. When a first current $I_1$ flows through the second winding set 30 from the first connection terminal 33*a* to the second connection terminal 33*b*, and a second current $I_2$ flows through the first winding set 20 form the first connection terminal 23*a* to the second connection terminal 23*b*, respectively, the first current $I_1$ and the second current $I_2$ generate a first magnetic flux Φ1 and a second magnetic flux Φ2 in the first magnetic column 11. As shown in FIG. 15, the first magnetic flux Φ1 and the second magnetic flux Φ2 have directions opposite to each other in the first magnetic column 11. Therefore, by using the arrangement of the connection terminals 23*a*, 23*b*, 33*a* and 33*b* of the magnetic component 1*f* coplanar on the second side S2 of the magnetic core 10*a*, the interconnection with the switch units can be conveniently realized, and the connection loss can be reduced. Certainly, the two-phase coupled inductor capable of being applied to the two-phase VRM is not limited to the magnetic component 1*f* of the embodiment, the foregoing various embodiments are applicable, but it is not redundantly described herein.

Figure 16:
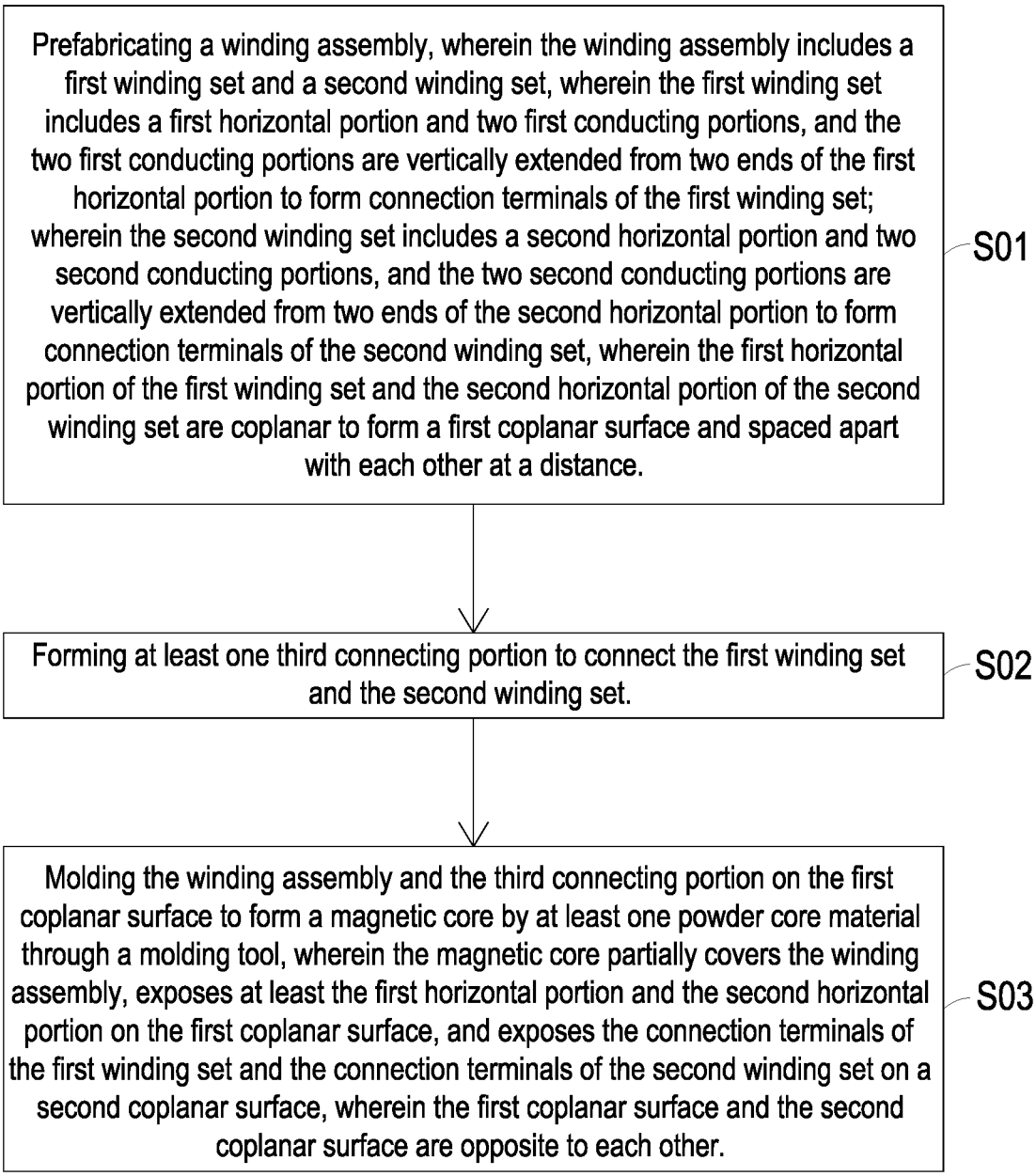
FIG. 16 is a flow chart illustrating a manufacturing method of a magnetic component according to an embodiment of the present disclosure.
Figure 17B:
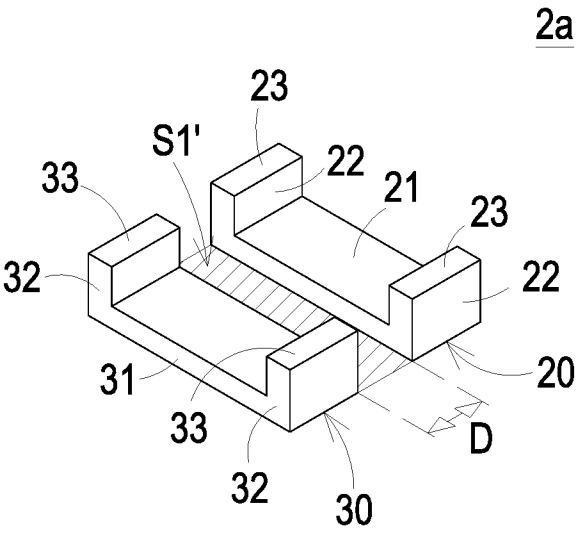
FIGS. 17A to 17F are exemplary structural views illustrating various stages of the manufacturing method of the magnetic component according to an embodiment of the present disclosure.
Figure 17A:
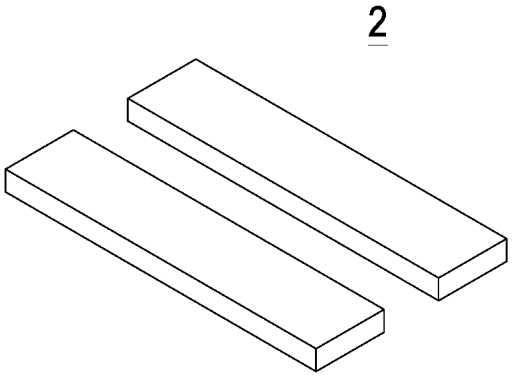
Figure 17D:
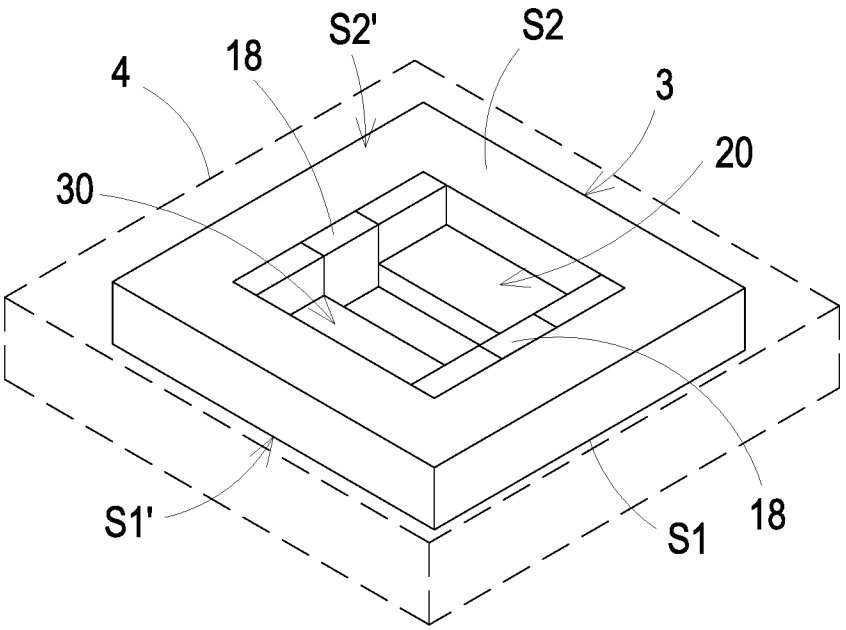
Figure 17C:
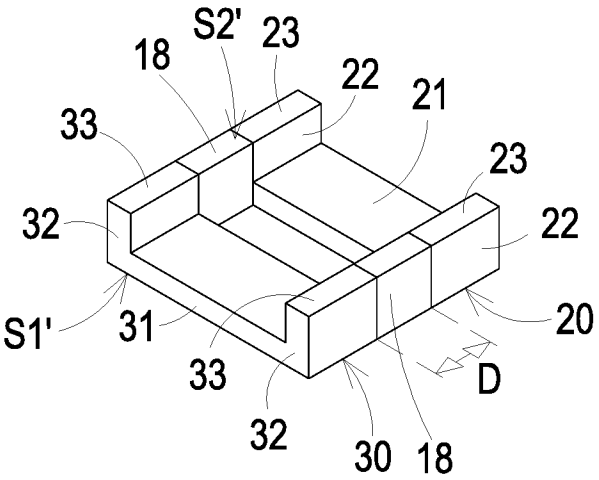
Figure 17F:
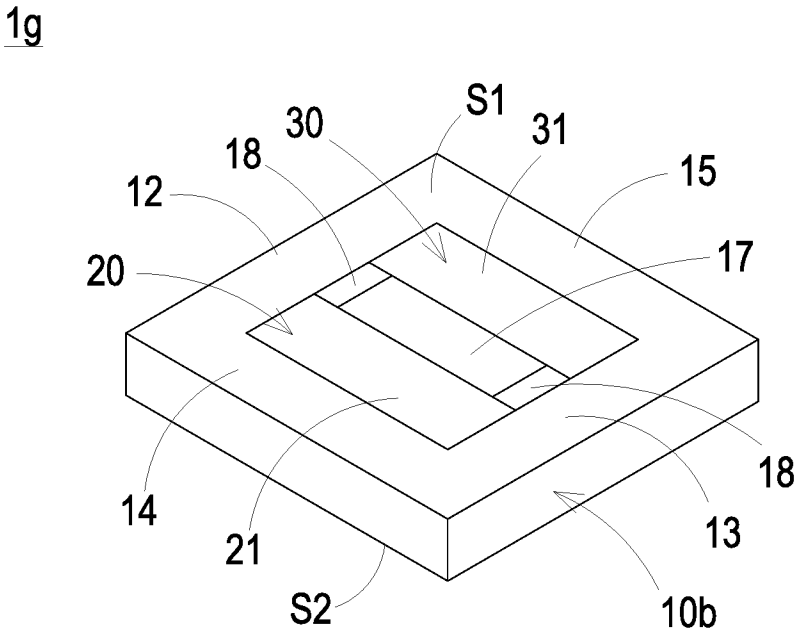
Figure 17E:
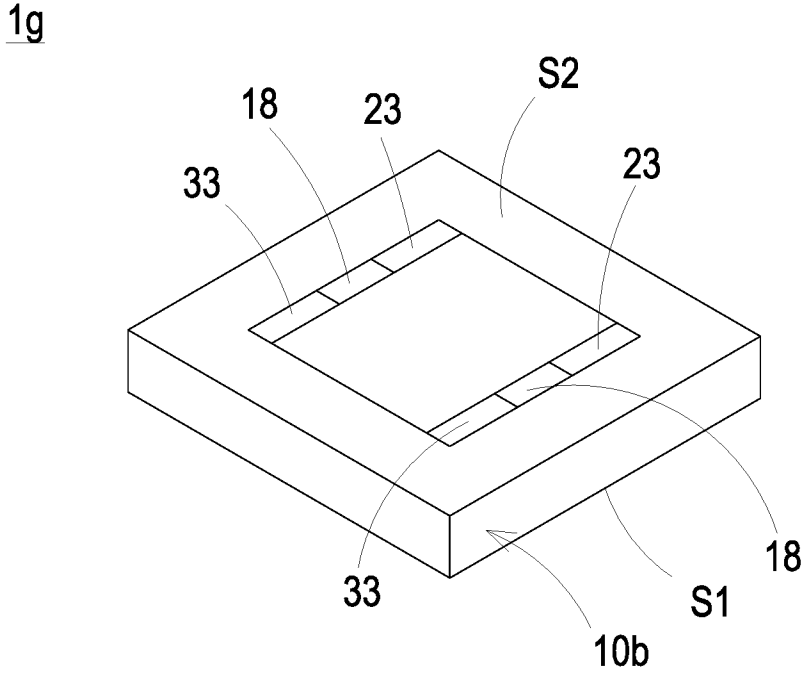

On the other hand, in combination with the prefabricated first winding set 20, the prefabricated second winding set 30 and the formed structure of the magnetic core 10, the present disclosure further provides a manufacturing method of a magnetic component. FIG. 16 is a flow chart illustrating a manufacturing method of a magnetic component according to an embodiment of the present disclosure. FIGS. 17A to 17F are exemplary structural views illustrating various stages of the manufacturing method of the magnetic component according to an embodiment of the present disclosure. Firstly, at the step S01, a winding assembly 2*a* is prefabricated. At that step, the winding assembly 2*a* can be made by, for example, a flat member 2 of the flat copper wire or a copper sheet, as shown in FIG. 17A, which is stamped or bent to form the winding assembly 2*a*, as shown in FIG. 17B. In the embodiment, the winding assembly 2*a* includes a first winding set 20 and a second winding set 30. The first winding set 20 includes a first horizontal portion 21 and two first conducting portions 22, and the two first conducting portions 22 are vertically extended from two ends of the first horizontal portion 21 to form connection terminals 23 of the first winding set 20. Moreover, the second winding set 30 includes a second horizontal portion 31 and two second conducting portions 32, and the two second conducting portions 32 are vertically extended from two ends of the second horizontal portion 31 to form connection terminals 33 of the second winding set 30. The first horizontal portion 21 of the first winding set 20 and the second horizontal portion 31 of the second winding set 30 are coplanar to form a first coplanar surface S1' and spaced apart with each other at a distance D. Thereafter, at the step S02, at least one third connecting portion 18 is formed to connect the first winding set 20 and the second winding set 30. In the embodiment, there are two third connecting portions 18 disposed between the first conducting portion 22 of the first winding set 20 and the second conducting portion 32 of the second winding set 30, respectively. Moreover, the third connecting portions 18 are exposed on the first coplanar surface S1' and a second coplanar surface S2'. The first coplanar surface S1' and the second coplanar surface S2' are opposite to each other. In the embodiment, the connection terminals 23 of the first winding set 20 and the connection terminals 33 of the second winding set 30 are coplanar with the third connecting portions 18 exposed on the second coplanar surface S2'. In the embodiment, the third connecting portions 18 are made for example by an epoxy material, so as to connect the first conducting portions 22 of the first winding set 20 with the second conducting portions 32 of the second winding set 30, respectively, as shown in FIG. 17C. Finally, at the step S03, as shown in FIG. 17E, a monolithic magnetic core 10*b* is formed directly. Namely, the winding assembly 2*a* and the third connecting portions 18 are molded on the first coplanar surface S1 by at least one powder core material through a molding tool 4 to form the magnetic core 10*b*. In the embodiment, the magnetic core 10*b* partially covers the winding assembly 2*a*, exposes at least the first horizontal portion 21 and the second horizontal portion 31 on the first coplanar surface S1', and exposes the connection terminals 23 of the first winding set 20 and the connection terminals 33 of the second winding set 30 on the second coplanar surface S2', as shown in FIGS. 17E and 17F. The first coplanar surface S1' and the second coplanar surface S2' are opposite to each other. It is noted that the manufacturing method of the magnetic component of the present disclosure may be fabricated by an integral molding method and it is not necessary to consider the assembly tolerance between the winding sets and the magnetic core 10. Therefore, it is advantageous for miniaturization of the inductor. In addition, the first winding set 20 and the second winding set 30 of the winding assembly 2*a* are one turn, respectively. When the molding tool 4 is pressed for molding in the manufacturing processes, the winding set may be deformed due to the pressure. Since the first winding set 20 and the second winding set 30 are one turn, respectively, and the thicknesses of the first winding set 20 and the second winding set 30 are thicker, it is easy to control the deformation of the first winding set 20 and the second winding set 30, so as to control the relative positions of the first winding set 20 and the second winding set 30. In the embodiment, the structures, elements and functions of the magnetic component 1*g* are similar to those of the magnetic component 1*d* in FIG. 9A to 9B, and are not redundantly described herein. Furthermore, at the step S03, a semi-cured limitation body 3 is prefabricated by at least one powder core material to limit the positions of the winding assembly 2*a* and the two third connecting portions 18. In the embodiment, the limitation body 3 can be for example a square-ring-shaped structure surrounding the periphery of the first winding set 20, the second winding set 30 and the third connecting portions 18 to limit the positions of the winding assembly 2*a* and the third connecting portions 18, as shown in FIG. 17D. It should be noted that it is more advantageous for controlling the position of the winding assembly 2*a* relative to the molding tool 4 in the manufacturing processes by utilizing the limitation body 3. Certainly, the present disclosure is not limited thereto. The semi-cured limitation body 3 at the step S03 is further molded with the other powder core material to form the entire structure of the magnetic core and completely cured.

Figure 18B:
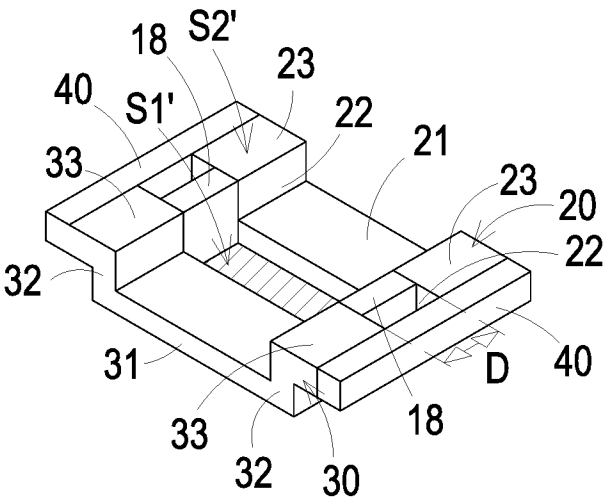
FIG. 18B is an example structural view illustrating the winging assembly of FIG. 18A combined with the third connecting portions according to the embodiment of the present disclosure.
Figure 18A:
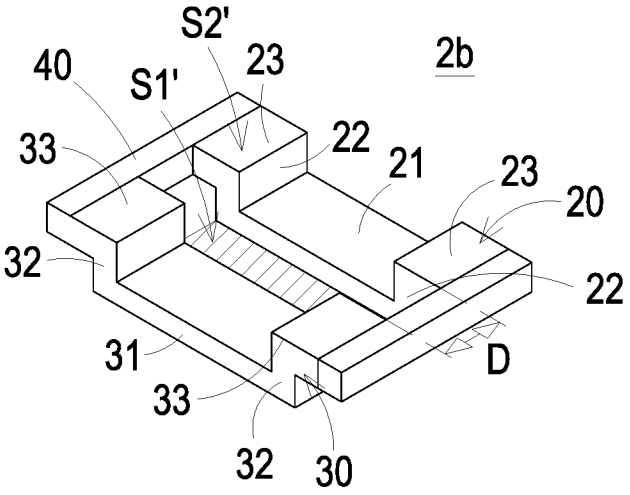
FIG. 18A is an exemplary structural view illustrating a winding assembly used in the manufacturing method of the magnetic component according to the embodiment of the present disclosure.

In addition, FIG. 18A is an exemplary structural view illustrating the winding assembly used in the manufacturing method of the magnetic component according to the embodiment of the present disclosure. FIG. 18B is an example structural view illustrating the winging assembly of FIG. 18A combined with the third connecting portions according to the embodiment of the present disclosure. It is noted that the integrally formed winding assembly 2*b* at the step S01 of the foregoing manufacturing method can be for example a leadframe formed by stamping or bending, as shown in FIG. 18A. In the embodiment, the winding assembly 2*b* further includes at least one jointing portion 40 to connect the two first conducting portions 22 of the first winding set 20 and the two second conducting portions 32 of the second winding set 30. Thus, the at least one jointing portion 40 can provide a structural support function in the manufacturing process, and it is more advantageous for controlling the first horizontal portion 21 of the first winding set 20 and the second horizontal portion 31 of the second winding set 30 to be coplanar on the first coplanar surface S1' and to be spaced apart with each other at the distance D. At the step S02, the two third connecting portions 18 are located between the first conducing portions 22 of the first winding set 20 and the second conducting portions 32 of the second winding set 30, thereby further strengthening the structural strength of the winding assembly 2*b*, as shown in FIG. 18B. Thereafter, at the step S03, the at least one jointing portion 40 is removed for example by cutting to form the first winding set 20 and the second winding set 30, and the two limitation parts 18, the connection terminals 23 of the first winding set 20 and the connection terminals 33 of the second winding set 30 are exposed to form the second coplanar surface S2 at the same time. Thus, it is beneficial to avoid the deformation of the winding set and reduce the tolerance caused by the winding assembly, thereby improving the dimensional accuracy.

Moreover, notably, in the above embodiments, the first air gap 16 can be for example served as the main magnetic flux air gap in the magnetic core 10. Preferably but not exclusively, the first air gap 16 is disposed on the first magnetic column 11 (as shown in FIG. 3). Alternatively, the first air gaps 16 are disposed on the second magnetic column 12 and the third magnetic column 13 (as shown in FIG. 1). The present disclosure is not limited thereto. In the other embodiments, the first air gaps 16 are disposed on the first connecting portion 14 and the second connecting portion 15. Detail explanation will be described as the following.

Figure 19A:
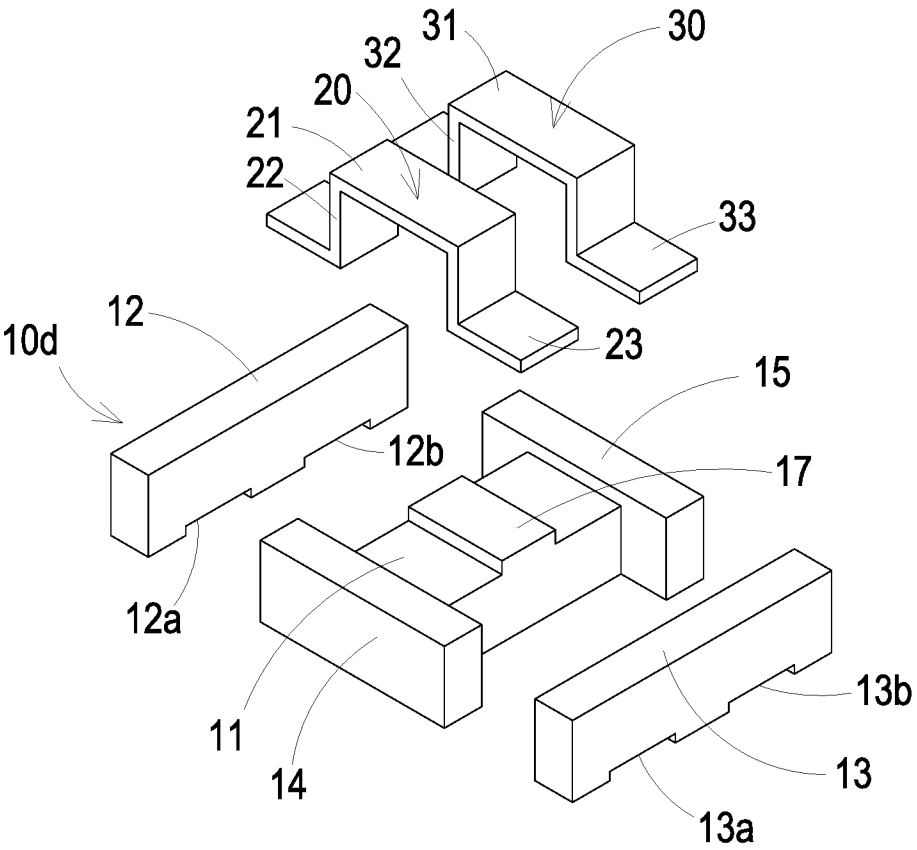
FIG. 19A is an exploded view illustrating the magnetic component according to an eighth embodiment of the present disclosure.
Figure 19C:
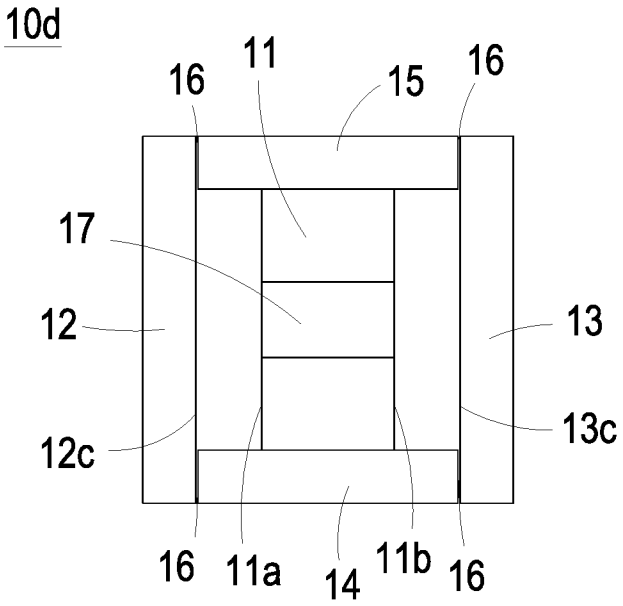
FIG. 19C is a top view illustrating the magnetic core of the magnetic component of FIG. 19B.
Figure 19B:
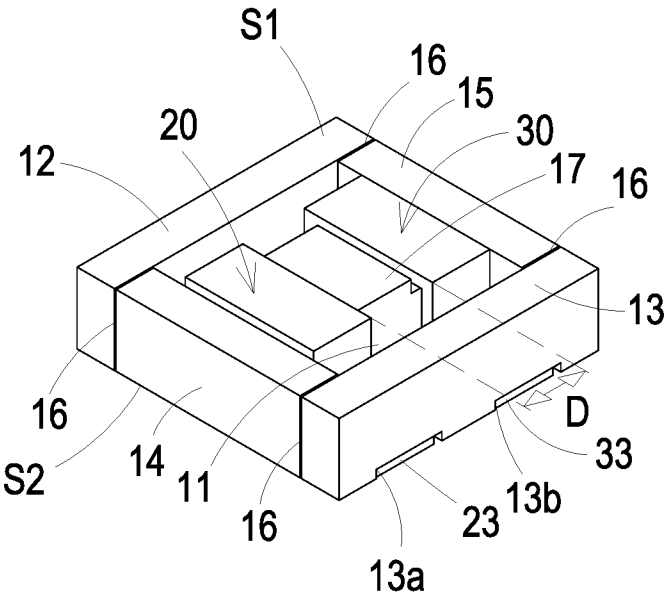
FIG. 19B is a perspective structural view illustrating the magnetic component according to the eighth embodiment of the present disclosure.

FIG. 19A is an exploded view illustrating the magnetic component according to an eighth embodiment of the present disclosure. FIG. 19B is a perspective structural view illustrating the magnetic component according to the eighth embodiment of the present disclosure. FIG. 19C is a top view illustrating the magnetic core of the magnetic component of FIG. 19B. In the embodiment, the structures, elements and functions of the magnetic component 1*h* and the magnetic core 10*d* are similar to those of the magnetic component 1*b* in FIGS. 5A and 5B and the magnetic core 10 in FIG. 6, and are not redundantly described herein. In the embodiment, the magnetic core 10*d* has a structure similar to that of the magnetic core 10 of FIG. 6, but the setting positions of the main magnetic flux air gaps are different. In the magnetic core 10 of FIG. 6, the entire structure of the magnetic core 10 is composed of two E-shaped magnetic cores to form the first magnetic column 11, the second magnetic column 12, the third column 13, the first connecting portion 14 and the second connecting portion 15. The first air gap 16 is disposed on the first magnetic column 11 and served as the main magnetic flux air gap. As shown in FIGS. 19A to 19C, in the embodiment, the entire structure of the magnetic core 10*d* is composed of two I-shaped magnetic cores and one H-shaped magnetic core to form the first magnetic column 11, the second magnetic column 12, the third magnetic column 13, the first connecting portion 14 and the second connecting portion 15. In the embodiment, the first winding set 20 and the second winding set 30 are respectively made by a flat conductive body in flatwise winding on the first magnetic column 11, and spaced apart with each other at a distance D. The first winding set 20 includes a first horizontal portion 21 and two first conducting portions 22. The two first conducting portions 22 are connected to each other through the first horizontal portion 21. The second winding set 30 includes a second horizontal portion 31 and two second conducting portions 32. The two second conducting portions 32 are connected to each other through the second horizontal portion 31. In the embodiment, the first horizontal portion 21 and the second horizontal portion 31 are at least partially exposed to the first side S1. The two first conducting portions 21 are extended to the two connection terminals 23 on the second side S2 to form two surface mounting pads on the second side S2. The two second conducting portion 31 are extended to the two connection terminal 33 on the second side S2 to form two surface mounting pads on the second side S2. In the embodiment, the first magnetic column 11 includes a first limitation part 17. The first limitation part 17 is disposed between the first horizontal portion 21 and the second horizontal portion 31. In addition, the second magnetic column 12 includes two recesses 12*a*, 12*b*, which are configured to accommodate one connection terminal 23 of the first winding set 20 and one connection terminal 33 of the second winding set 30, respectively. The second magnetic column 13 includes two recesses 13*a*, 13*b*, which are configured to accommodate another connection terminal 23 of the first winding set 20 and another connection terminal 33 of the second winding set 30. The arrangements of the recesses 12*a*, 12*b* of the second magnetic column 12, the recesses 13*a*, 13*b* of the third magnetic column 13, and the limitation part 17 of the first magnetic column 11 are beneficial to reduce the total height of the entire inductor. The present disclosure is not limited thereto.

Notably, in the embodiment, the first air gaps 16 for adjusting the main magnetic flux are disposed on the first connecting portion 14 and the second connecting portion 15. Preferably but not exclusively, each of the first connecting portion 14 and the second connecting portion 15 includes a pair of first air gaps 16. The pair of first air gaps 16 spatially correspond to two opposite lateral sides 11*a*, 11*b* of the first magnetic column 11, respectively, and located between the first magnetic column 11 and the second magnetic column 12 and between the first magnetic column 11 and the third magnetic column 13. In that, there are four first air gaps 16 served as the main magnetic flux air gap. In the embodiment, the pair of first air gaps 16 of the first connecting portion 14 are adjacent to a lateral side 12*c* of the second magnetic column 12 and a lateral side 13*c* of the third magnetic column 13. The pair of first air gaps 16 of the second connecting portion 15 are adjacent to the lateral side 12*c* of the second magnetic column 12 and the lateral side 13*c* of the third magnetic column 13. Compared with the magnetic core 10 including the first air gap 16 disposed on the first magnetic column 11, the magnetic core 10*d* includes more first air gaps 16, and the length of each air gap 16 can be shorter to improve the amount of the air-gap fringing flux, thereby reducing the fringing loss of winding.

Figure 20A:
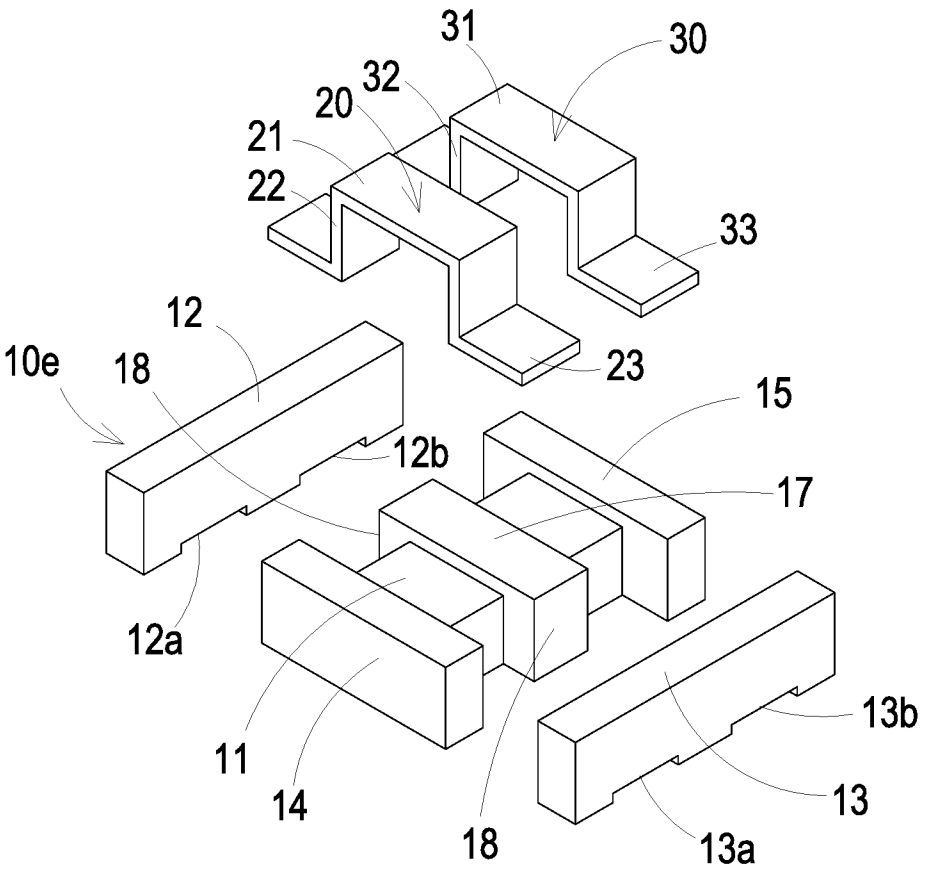
FIG. 20A is an exploded view illustrating the magnetic component according to a ninth embodiment of the present disclosure.
Figure 20C:
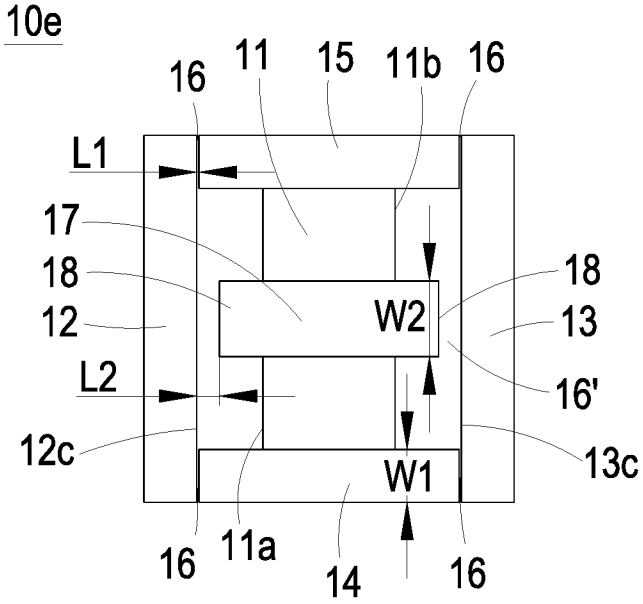
FIG. 20C is a top view illustrating the magnetic core of the magnetic component of FIG. 20B.
Figure 20B:
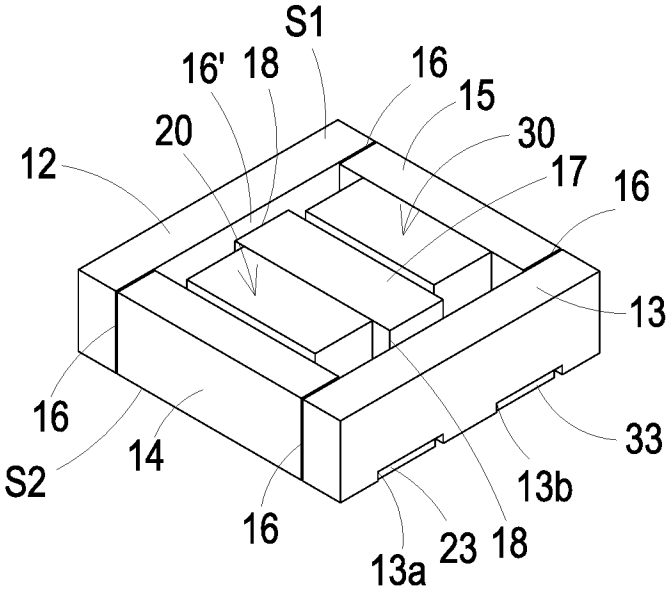
FIG. 20B is a perspective structural view illustrating the magnetic component according to the ninth embodiment of the present disclosure.

FIG. 20A is an exploded view illustrating the magnetic component according to a ninth embodiment of the present disclosure. FIG. 20B is a perspective structural view illustrating the magnetic component according to the ninth embodiment of the present disclosure. FIG. 20C is a top view illustrating the magnetic core of the magnetic component of FIG. 20B. In the embodiment, the structures, elements and functions of the magnetic component 1*k* and the magnetic core 10*e* are similar to those of the magnetic component 1*h* and the magnetic core 10*d* in FIGS. 19A to 19C, and are not redundantly described herein. In the embodiment, the magnetic core 10*e* further includes a third connecting portion 18, which is extended from two opposite lateral side 11*a*, 11*b* of the first magnetic column 11 toward the second magnetic column 12 and the third magnetic column 13, respectively. The third connecting portion 18 is located between the first connecting portion 14 and the second connecting portion 15, and also located between the first winding set 20 and the second winding set 30. Preferably but not exclusively, in the embodiment, the magnetic core 10*e* is composed of two I-shaped magnetic cores and one "王"-shaped magnetic core to form the first magnetic column 11, the second magnetic column 12, the third column 13, the first connecting portion 14, the second connecting portion 15 and the third connecting portion 18. The present disclosure is not limited thereto. In another embodiment, the magnetic core 10*e* is composed of two T-shaped magnetic cores and one H-shaped magnetic core to form the first magnetic column 11, the second magnetic column 12, the third magnetic column 13, the first connecting portion 14, the second connecting portion 15 and the third connecting portion 18. It is not redundantly described herein. In the embodiment, the third connecting portion 18 further includes a pair of second air gaps 16' located between the first magnetic column 11 and the second magnetic column 12 and between the first magnetic column 11 and the third magnetic column 13, respectively, so that the second air gaps 16' are served as the leakage flux air gaps. In the embodiment, the pair of second air gaps 16' are adjacent to the lateral side 12*c* of the second magnetic column 12 and the lateral side 13*c* of the third magnetic column 13, respectively. In another embodiment, the pair of second air gaps 16' are adjacent to the two opposite lateral sides 11*a*, 11*b* of the first magnetic column 11. The present disclosure is not limited thereto. When the windings are connected with the external circuit in an inverse-coupling manner, the currents in the first winding set 20 and the second winding set 30 have the same magnetic flux direction on the third connecting portion 18, and are superposed on each other. Therefore, the width W2 of the third connecting portion 18 is preferably greater than the width W1 of the first connecting portion 14 and the second connecting portion 15. Preferably but not exclusively, the width W2 is ranged from 1.5 times the width W1 to 2.5 times the width W1. Compared with the magnetic core 10*d* of FIGS. 19A to 19C, in the embodiment, the magnetic core 10*e* is more advantageous for adjusting the magnitude of leakage inductance and achieving the leakage inductance in a wider adjusting range. In the embodiment, the adjustment of the magnitude of the leakage inductance of the magnetic core 10*e* can be achieved by adjusting the length L2 of the second air gap 16'. Increasing the length L2 of the second air gap 16' can reduce the amount of leakage inductance and increase the coupling coefficient. In the embodiment, the first air gap 16 served as the main flux air gap has a length L1. The second air gap 16' served as the leakage-flux air gap has a length L2. Preferably but not exclusively, the length L2 of the second air gap 16' is greater than the length L1 of the first air gap 16.

In the embodiment, the first magnetic column 11, the second magnetic column 12, the third magnetic column 13, the first connecting portion 14, the second connecting portion 15 and the third connecting portion 18 of the magnetic core 10*e* are made of for example but not limited to a ferrite material or a powder core material. Notably, the loss of the ferrite material is lower but the saturation magnetic flux density thereof is low. Therefore, the magnetic core made of the ferrite material tends to have a larger size. On the contrary, the powder core material has a larger saturation magnetic flux, the size of the magnetic core made of the powder core material has a chance to be reduced, but the loss characteristics thereof are not good. In the present disclosure, the first magnetic column 11, the second magnetic column 12, the third magnetic column 13, the first connecting portion 14, the second connecting portion 15, and the third connecting portion 18 can be constructed by using different types of materials to optimize the performance of the magnetic core structure.

Figure 21A:
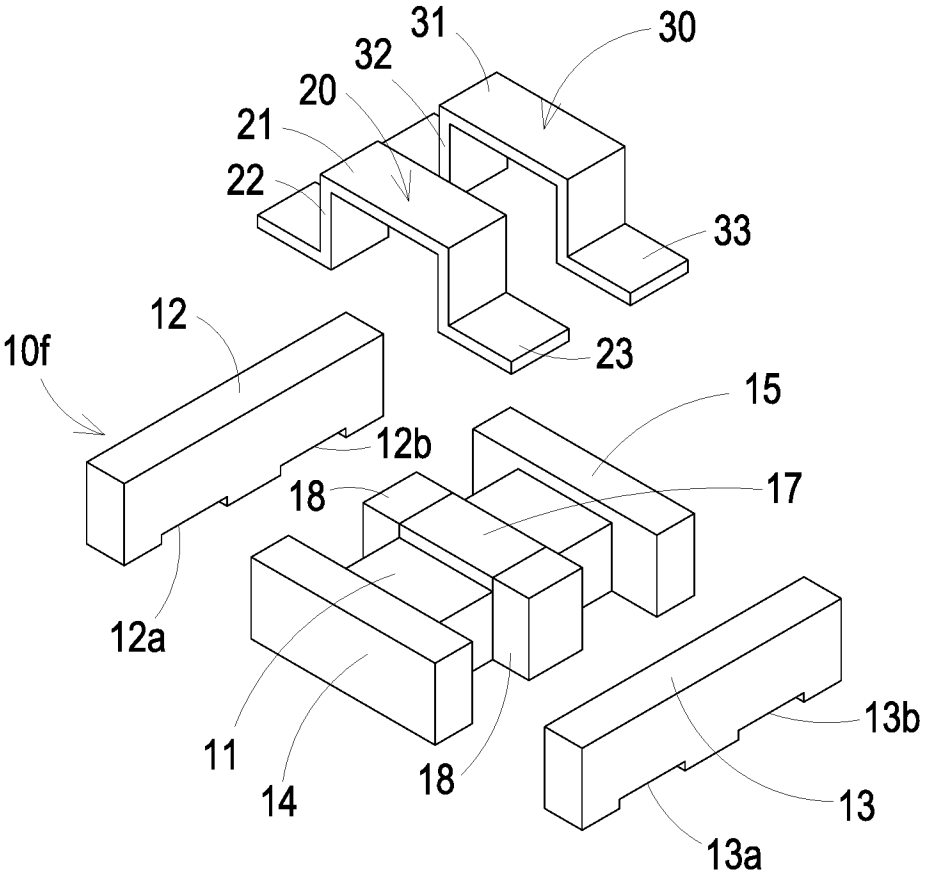
FIG. 21A is an exploded view illustrating the magnetic component according to a tenth embodiment of the present disclosure.
Figure 21C:
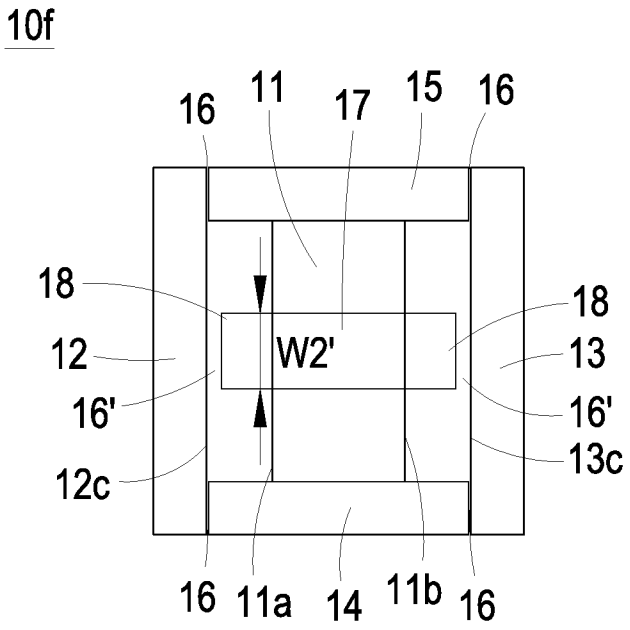
FIG. 21C is a top view illustrating the magnetic core of the magnetic component of FIG. 21B.
Figure 21B:
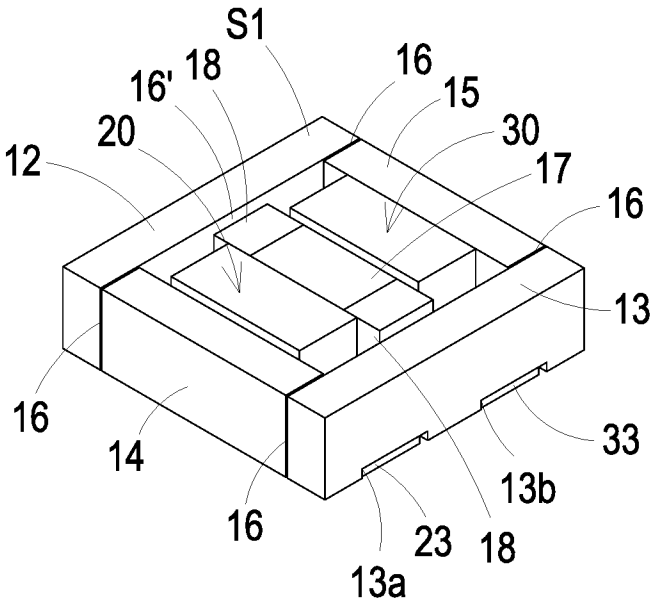
FIG. 21B is a perspective structural view illustrating the magnetic component according to the tenth embodiment of the present disclosure.

FIG. 21A is an exploded view illustrating the magnetic component according to a tenth embodiment of the present disclosure. FIG. 21B is a perspective structural view illustrating the magnetic component according to the tenth embodiment of the present disclosure. FIG. 21C is a top view illustrating the magnetic core of the magnetic component of FIG. 21B. In the embodiment, the structures, elements and functions of the magnetic component 1*m* and the magnetic core 10*f* are similar to those of the magnetic component 1*k* and the magnetic core 10*e* in FIGS. 20A to 20C, and are not redundantly described herein. Different from the magnetic core 10*e* made of the ferrite material merely in FIGS. 20A to 20C, in the embodiment, the first magnetic column 11, the second magnetic column 12, the third magnetic column 13, the first connecting portion 14 and the second connecting portion 15 of the magnetic core 10*f* are made of the ferrite material. The third connecting portion 18 of the magnetic core 10*f* is made of the powder core material. Namely, the third connecting portion 18 has a relative permeability lower than that of each of the first magnetic column 11, the second magnetic column 12, the third magnetic column 13, the first connecting portion 14 and the second connecting portion 15. Compared with the magnetic core 10*e* made of the ferrite material merely in FIGS. 20A to 20C, in the embodiment, the width W2' of the third connecting portion 18 composed of the powder core material can be further reduced. Thus, the magnetic core 10*f* made of the powder core material benefits to reduce the entire inductance volume significantly. Moreover, since a small amount of the powder core material is used, the loss of the magnetic core is increased slightly. Preferably but not exclusively, in the embodiment, the first magnetic column 11, the second magnetic column 12, the third magnetic column 13, the first connecting portion 14 and the second connecting portion 15 are composed of one H-shaped magnetic core and two I-shaped magnetic cores. The third connecting portion 18 made of the powder core material can be implemented, for example, by the two means described as the following. The first means is implemented by sealing. Meanwhile, the first magnetic column 11, the second magnetic column 12, the third magnetic column 13, the first connecting portion 14 and the second connecting portion 15 are assembled with the first winding set 20 and the second winding set 30. Thereafter, the magnetic powder with binder is filled into the space between the first winding set 20 and the second winding set 30 and solidified to form the third connecting portion 18. The second means is implemented by molding. For example, the first winding set 20, the second winding set 30 and the magnetic powder are placed into a pre-designed mold, and pressed to form a combination body of the first winding set 20, the second winding set 30 and the third connecting portion 18. Finally, the combination body is assembled with the first magnetic column 11, the second magnetic column 12, the third magnetic column 13, the first connecting portion 14 and the second connecting portion 15 made of the ferrite material to form the entire inductor. Certainly, the present disclosure is not limited thereto. In the embodiment, the adjustment of the leakage inductance in the magnetic core 10*f* can be achieved by adjusting the second air gap 16' and the width W2' and the permeability of the third connecting portion 18.

Figure 22A:
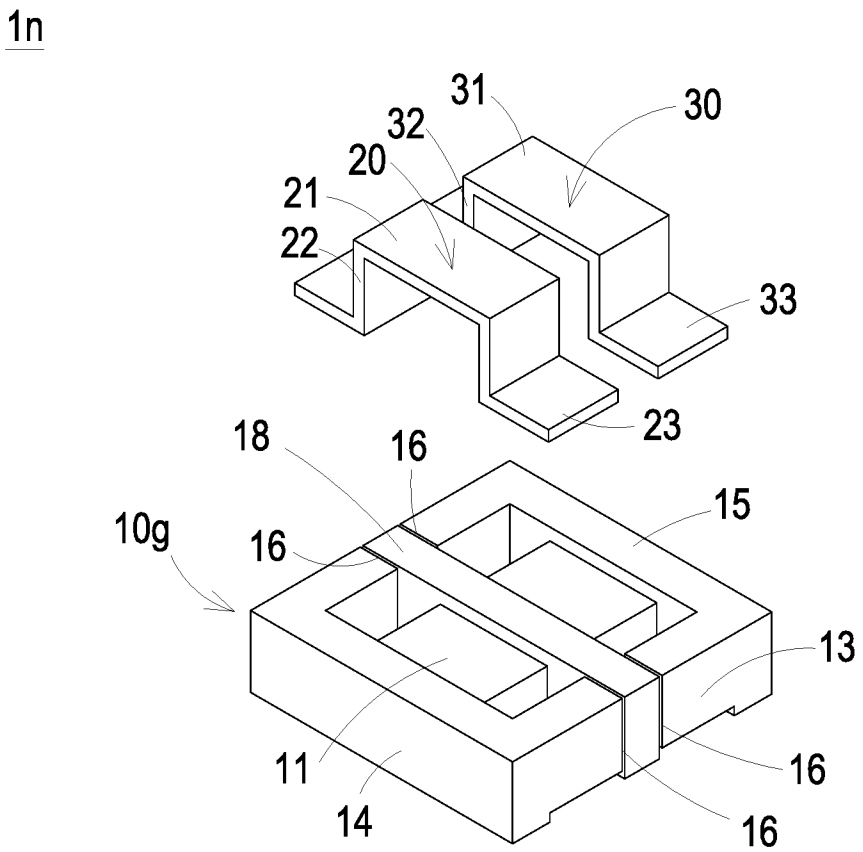
FIG. 22A is an exploded view illustrating the magnetic component according to an eleventh embodiment of the present disclosure.
Figure 22C:
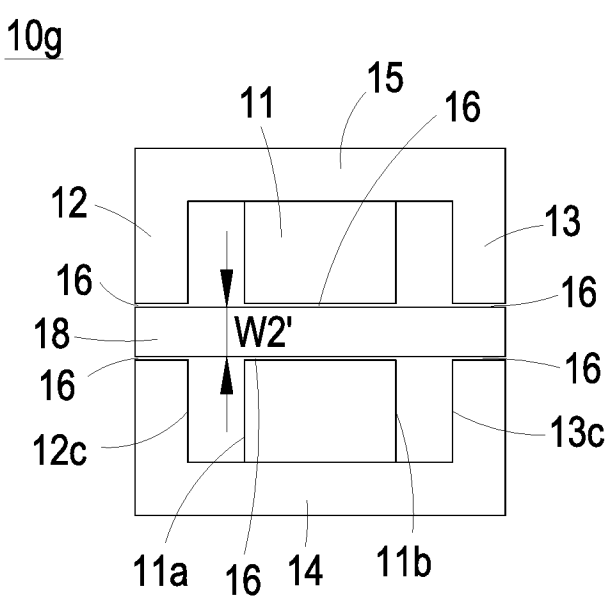
FIG. 22C is a top view illustrating the magnetic core of the magnetic component of FIG. 22B.
Figure 22B:
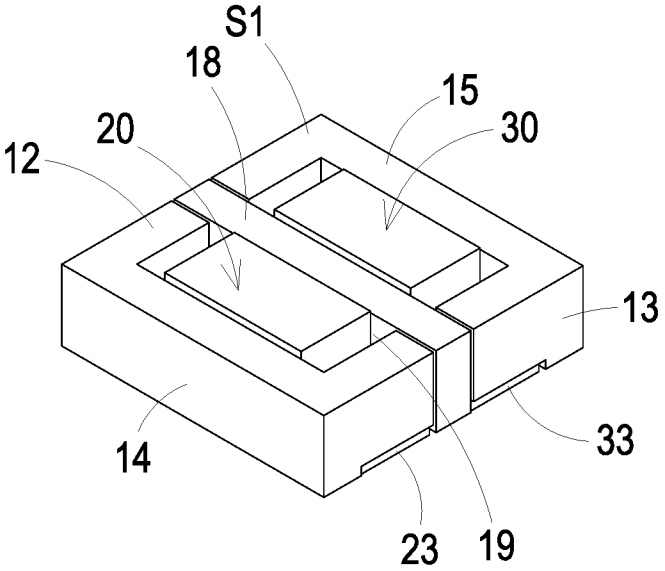
FIG. 22B is a perspective structural view illustrating the magnetic component according to the eleventh embodiment of the present disclosure.

FIG. 22A is an exploded view illustrating the magnetic component according to an eleventh embodiment of the present disclosure. FIG. 22B is a perspective structural view illustrating the magnetic component according to the eleventh embodiment of the present disclosure. FIG. 22C is a top view illustrating the magnetic core of the magnetic component of FIG. 22B. In the embodiment, the structures, elements and functions of the magnetic component 1*n* and the magnetic core 10*g* are similar to those of the magnetic component 1*m* and the magnetic core 10*f* in FIGS. 21A to 21C, and are not redundantly described herein. In the embodiment, the third connecting portion 18 further runs through the first magnetic column 11, the second magnetic column 12 and the third magnetic column 13, so as to improve the saturation characteristics. In the embodiment, the whole third connecting portion 18 is made of the powder core material, and the contact area between the ferrite material of the first magnetic column 11, the second magnetic column 12 and the third magnetic column 13 and the powder core material of the third connecting portion 18 is increased. The saturation problem of a part of the ferrite material in the first magnetic column 11, the second magnetic column 12 and the third magnetic column 13 can be avoided effectively, and the inductance saturation capability can be improved. In the embodiment, the magnetic core 10*g* is composed of two E-shaped magnetic cores to form the first magnetic column 11, the second magnetic column 12, the third magnetic column 13, the first connecting portion 14 and the second connecting portion 15. Moreover, the third connecting portion 18 in I shape and made of the powder core material is further assembled with the two E-shaped magnetic cores. FIG. 22D is a schematic diagram showing the magnetic circuit model of the magnetic component of FIG. 22A. As shown in FIG. 22D, the magnetic component 10*g* has a magnetomotive force Emmf1 and a magnetomotive force Emmf2, which are corresponding to the first winding set 20 and the second winding set 30 wound on the first magnetic column 11. The first magnetic column 11 has a reluctance R11 and a reluctance R12. The second magnetic column 12 has a reluctance R21 and a reluctance R22. The third magnetic column 13 has a reluctance R31 and a reluctance R32. The third connecting portion 18 has a leakage reluctance R01 and a leakage reluctance R02. Preferably but not exclusively, in this embodiment, the first magnetic column 11, the second magnetic column 12 and the third magnetic column 13 are configured as a symmetrical structure. In that, R11=R12=R1, R21=R22=R31=R32=R2 and R01=R02=R0. The coupling coefficient k can be expressed as k=R0/(2×R1+R2+R0). By adjusting the values of R1, R2, and R0, the different coupling coefficients are achieved. In particular, there are three main parameters for adjusting the inductance and the coupling degree. The parameters are: the width W2' of the third connecting portion 18, the powder core permeability u of the third connecting portion 18, and the length of the first air gap 16. Certainly, the length of the air gaps on the first magnetic column 11 and the length of the air gaps on the second magnetic column 12 and the third magnetic column 13 can be different. When the width W2' of the third connecting portion 18 is decreased, R0 is increased, R1 and R2 are decreased, and the coupling effect is improved. In addition, when the powder core permeability u is changed, the self-inductance and the leakage inductance are changed synchronously, thus the influence of the coupling coefficient k is not sensitive. The smaller the length of the air gap is, the smaller the R1 and R2 are, and the coupling is getting better.

Figure 22E:
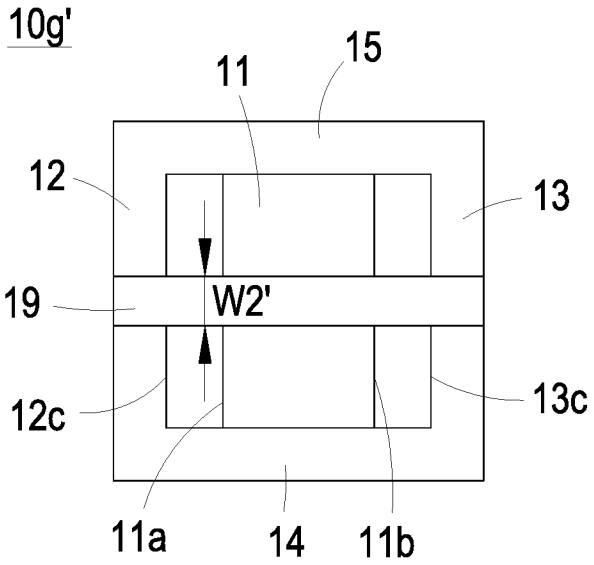
FIG. 22E is a top view illustrating the magnetic core of the magnetic component according to another embodiment of the present disclosure.
Figure 22D:
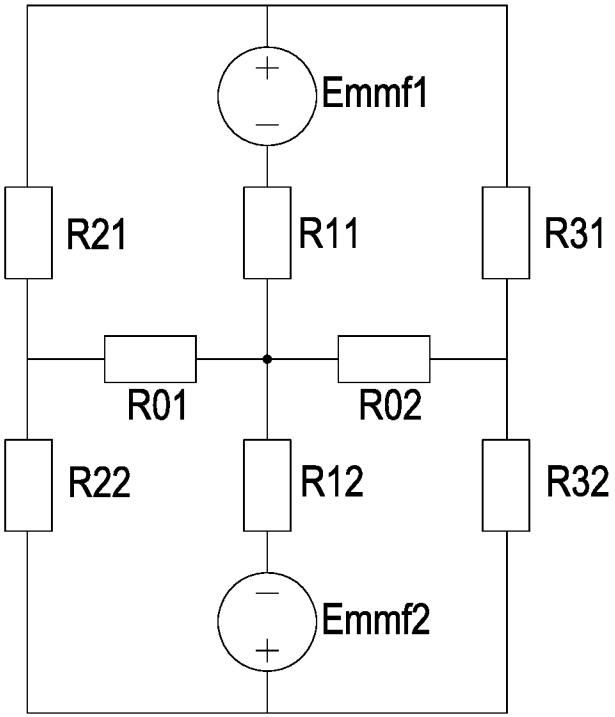
FIG. 22D is a schematic diagram showing the magnetic circuit model of the magnetic component of FIG. 22A.

FIG. 22E is a top view illustrating the magnetic core of the magnetic component according to another embodiment of the present disclosure. In order to achieve better coupling, the lengths of the air gaps on the first magnetic column 11, the second magnetic column 12 and the third magnetic column 13 can be zero. Namely, there is no air gap disposed in the magnetic core 10*g*'. In an exemplary embodiment, the powder core permeability u is equal to 15, the widths of the first connecting portion 14 and the second connecting portion 15 are equal to 1.5 mm, there is no air gap disposed in the magnetic column, and the width W2' of the third connecting portion 18 is equal to 1.3 mm. Correspondingly, the leakage inductance Llk=75 nH, the self-inductance Lself=180 nH, the coupling coefficient k=0.58 are obtained and as shown in Table 1.

TABLE 1

| W2' (mm) | u | air gap (mm) | leakage inductance Llk (nH) | self-inductance Lself (nH) | coupling coefficient k |
|---|---|---|---|---|---|
| 1.3 | 15 | 0 | 75 | 180 | 0.58 |

In addition, it is noted that if it is desired to further increase the coupling coefficient k, the width W2' of the third connecting portion 18 needs to be reduced, but the leakage inductance is becoming too small at this time. On the other hand, the minimum value of the width W2' of the third connecting portion 18 is also limited by the saturation characteristics of the powder core material. In the inverse-coupling applications, the typical requirement is in the case of a higher coupling coefficient, meanwhile the leakage inductance should be kept. In order to increase the adjusting range of the inductance, the width W2' of the third connecting portion 18 can be further changed in the present disclosure.

Figure 23A:
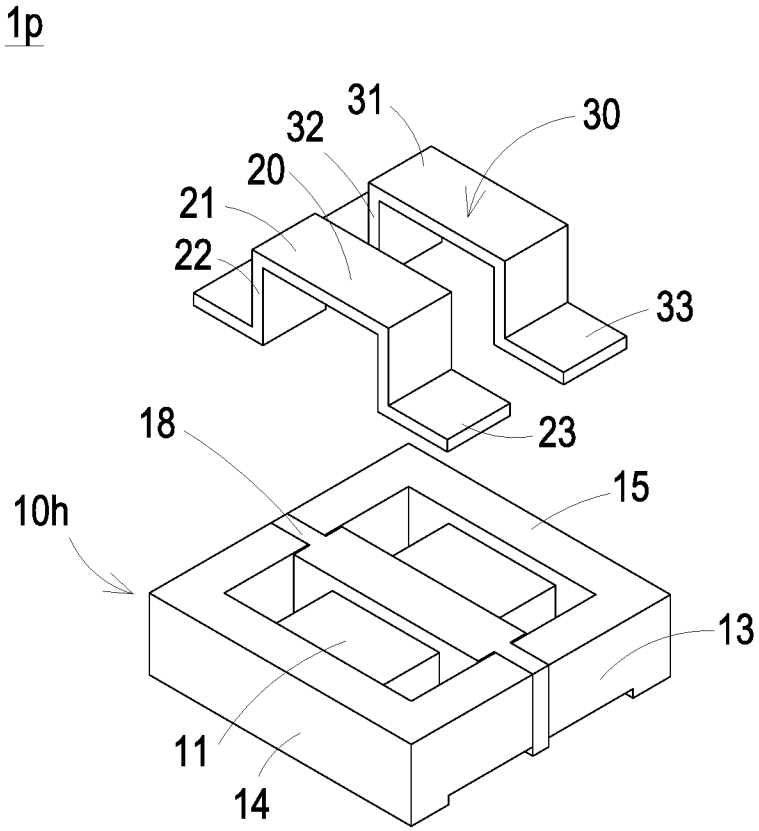
FIG. 23A is an exploded view illustrating the magnetic component according to a twelfth embodiment of the present disclosure.
Figure 23C:
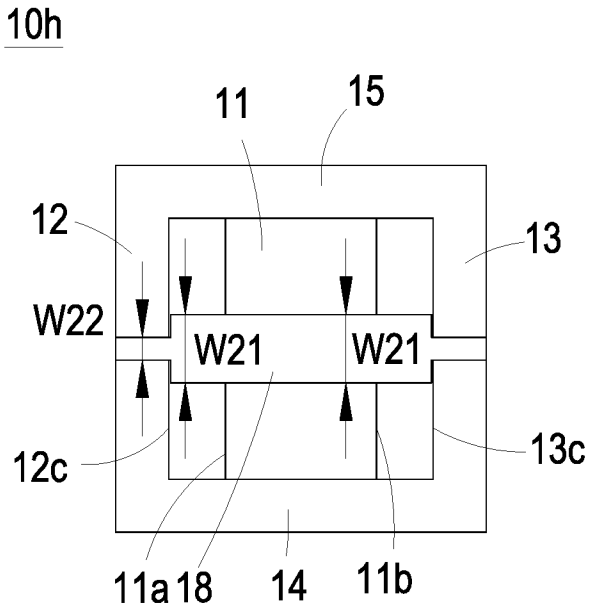
FIG. 23C is a top view illustrating the magnetic core of the magnetic component of FIG. 23B.
Figure 23B:
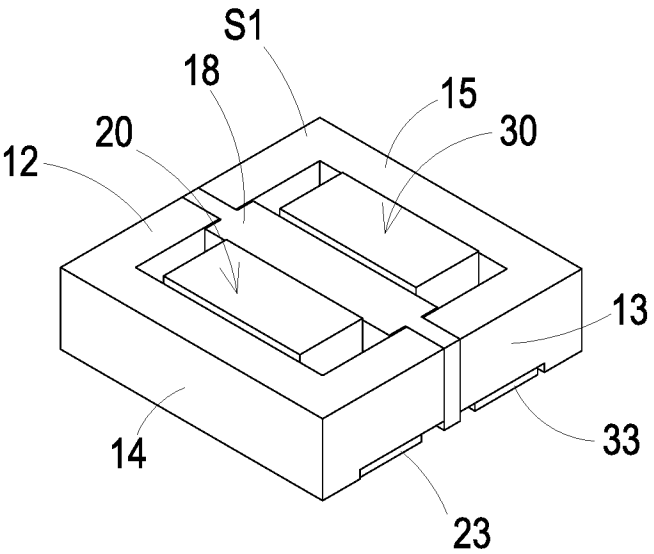
FIG. 23B is a perspective structural view illustrating the magnetic component according to the twelfth embodiment of the present disclosure.

FIG. 23A is an exploded view illustrating the magnetic component according to a twelfth embodiment of the present disclosure. FIG. 23B is a perspective structural view illustrating the magnetic component according to the twelfth embodiment of the present disclosure. FIG. 23C is a top view illustrating the magnetic core of the magnetic component of FIG. 23B. In the embodiment, the structures, elements and functions of the magnetic component 1*p* and the magnetic core 10*h* are similar to those of the magnetic component 1*n* and the magnetic core 10*g* in FIGS. 22A to 22C, and are not redundantly described herein. In the embodiment, the third connecting portion 18 includes at least one first width W21 and at least one second width W22. Preferably but not exclusively, the first width W21 is located at a position where the third connecting portion 18 is offset from the first magnetic column 11, the second magnetic column 12 and the third magnetic column 13 and a position where the third connecting portion 18 runs through the first magnet column 11. The second width W22 is located at a position where the third connecting portion 18 runs through the second magnetic column 12 and the third magnetic column 13. In the embodiment, the first width W21 is greater than the second width W22. The first width W21 and the second width W22 are different from each other. In the embodiment, the position where the third connecting portion 18 runs through the second magnetic column 12 and the third magnetic column 13 has the second width W22 less than the first width W21 of other positions of the third connecting portion 18. In that, when the leakage reluctance R0 is maintained and the reluctance R2 of the second magnetic column 12 and the third magnetic column 13 is reduced, the self-inductance and the coupling coefficient are improved. In an exemplary embodiment, the powder core permeability u is equal to 15, there is no air gap disposed in the first magnetic column 11, the second magnetic column 12 and the third magnetic column 13, the first width W21 is equal to 1.3 mm, and the second width W22 is equal to 0.5 mm. Correspondingly, the leakage inductance Llk=75 nH, the self-inductance Lself=245 nH, the coupling coefficient k=0.69 are obtained and as shown in Table 2.

TABLE 2

| W21 (mm) | W22 (mm) | u | air gap (mm) | leakage inductance Llk (nH) | self-inductance Lself (nH) | coupling coefficient k |
|---|---|---|---|---|---|---|
| 1.3 | 0.5 | 15 | 0 | 75 | 245 | 0.69 |

Compared with the use of the magnetic core 10*g*' shown in FIG. 22E, the coupling coefficient k is more effectively improved by using the structure of the magnetic core 10*h* under the condition of maintaining the leakage inductance.

Figure 24A:
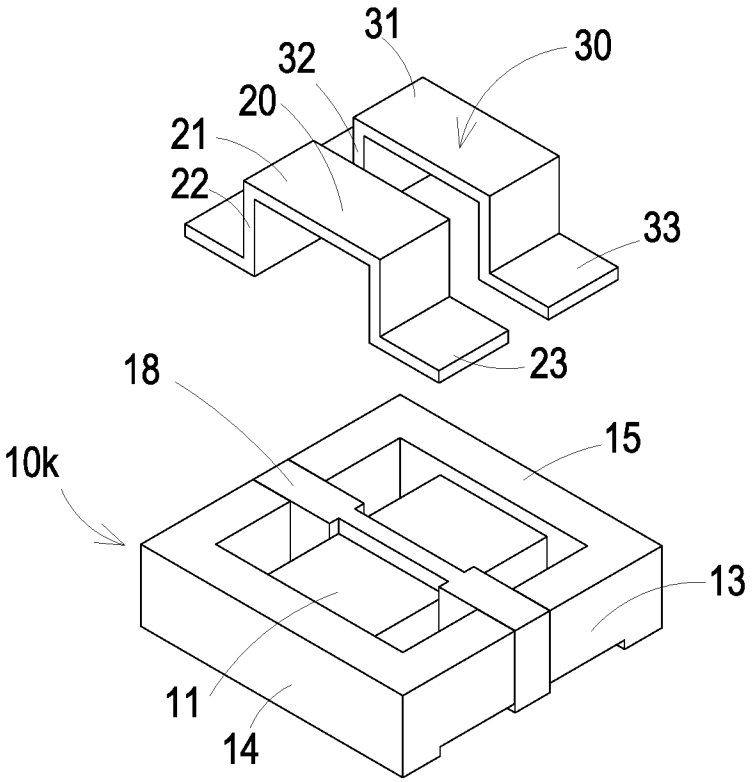
FIG. 24A is an exploded view illustrating the magnetic component according to a thirteenth embodiment of the present disclosure.
Figure 24C:
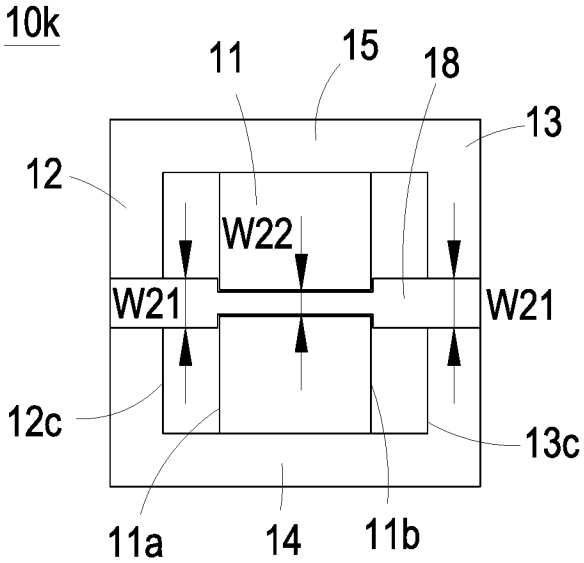
FIG. 24C is a top view illustrating the magnetic core of the magnetic component of FIG. 24B.
Figure 24B:
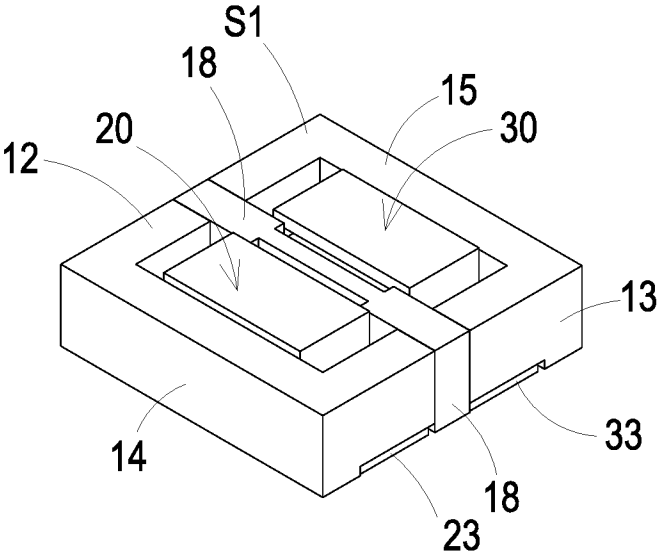
FIG. 24B is a perspective structural view illustrating the magnetic component according to the thirteenth embodiment of the present disclosure.

FIG. 24A is an exploded view illustrating the magnetic component according to a thirteenth embodiment of the present disclosure. FIG. 24B is a perspective structural view illustrating the magnetic component according to the thirteenth embodiment of the present disclosure. FIG. 24C is a top view illustrating the magnetic core of the magnetic component of FIG. 24B. In the embodiment, the structures, elements and functions of the magnetic component 1*r* and the magnetic core 10*k* are similar to those of the magnetic component 1*n* and the magnetic core 10*g* in FIGS. 22A to 22C, and are not redundantly described herein. In the embodiment, the third connecting portion 18 includes at least one first width W21 and at least one second width W22. Preferably but not exclusively, the first width W21 is located at a position where the third connecting portion 18 is offset from the first magnetic column 11, the second magnetic column 12 and the third magnetic column 13 and a position where the third connecting portion 18 runs through the second magnet column 12 and the third magnetic column 13. The second width W22 is located at a position where the third connecting portion 18 runs through the first magnetic column 11. In the embodiment, the first width W21 is greater than the second width W22. The first width W21 and the second width W22 are different from each other. In the embodiment, the position where the third connecting portion 18 runs through the first magnetic column 11 has the second width W22 less than the first width W21 of other positions of the third connecting portion 18. In that, when the leakage reluctance R0 is maintained and the reluctance R1 of the first magnetic column 11 is reduced, the coupling coefficient is improved.

Figure 25A:
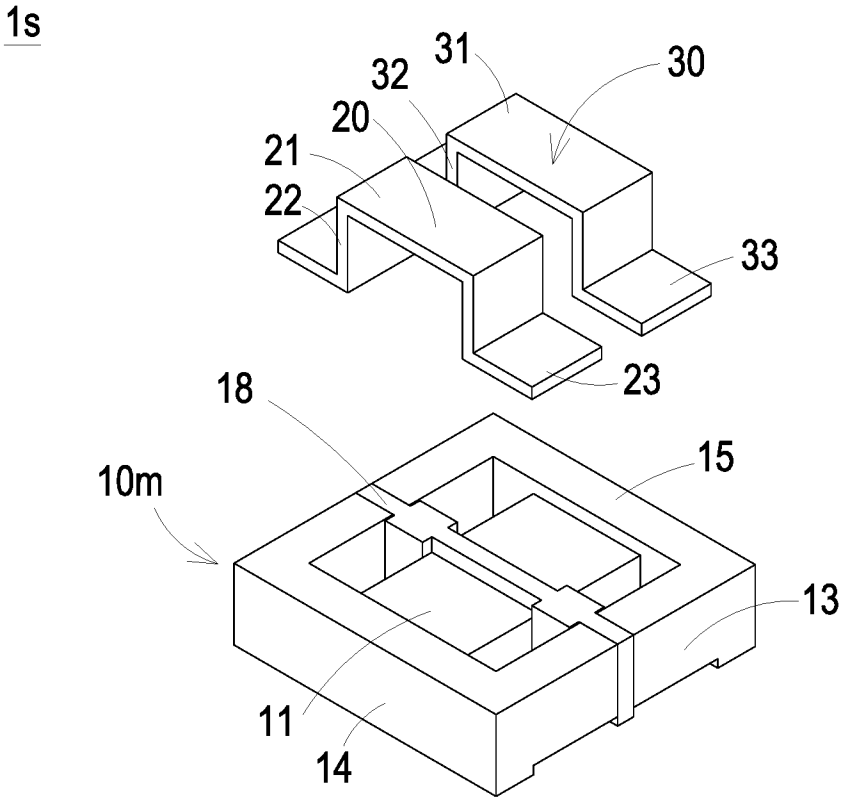
FIG. 25A is an exploded view illustrating the magnetic component according to a fourteenth embodiment of the present disclosure.
Figure 25C:
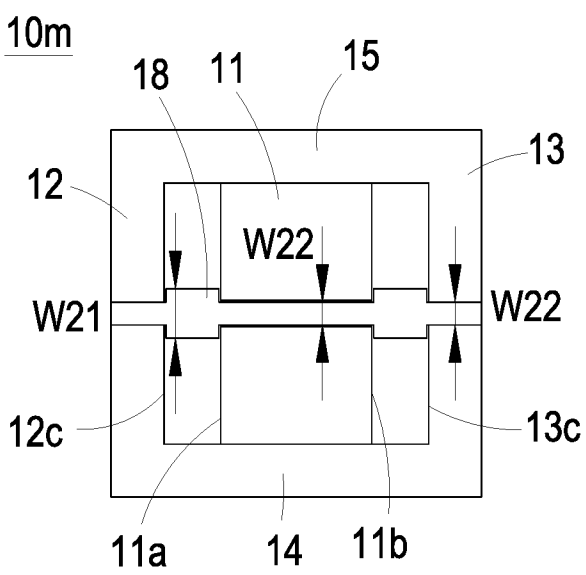
FIG. 25C is a top view illustrating the magnetic core of the magnetic component of FIG. 25B.
Figure 25B:
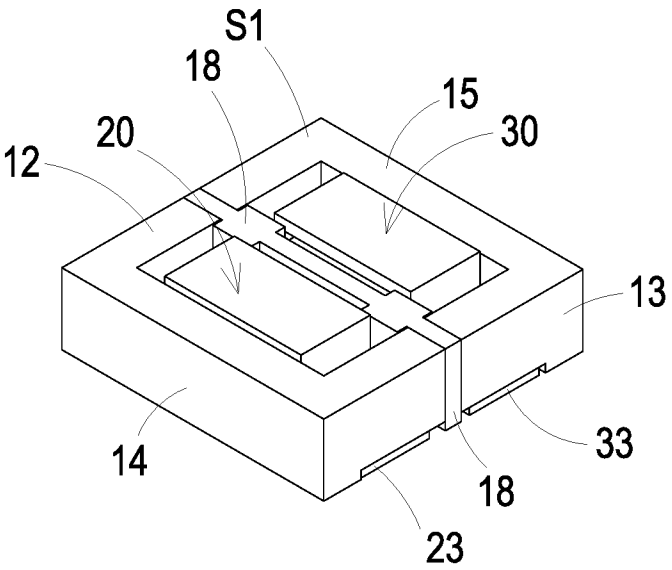
FIG. 25B is a perspective structural view illustrating the magnetic component according to the fourteenth embodiment of the present disclosure.

FIG. 25A is an exploded view illustrating the magnetic component according to a fourteenth embodiment of the present disclosure. FIG. 25B is a perspective structural view illustrating the magnetic component according to the fourteenth embodiment of the present disclosure. FIG. 25C is a top view illustrating the magnetic core of the magnetic component of FIG. 25B. In the embodiment, the structures, elements and functions of the magnetic component 1*s* and the magnetic core 10*m* are similar to those of the magnetic component 1*n* and the magnetic core 10*g* in FIGS. 22A to 22C, and are not redundantly described herein. In the embodiment, the third connecting portion 18 includes at least one first width W21 and at least one second width W22. Preferably but not exclusively, the first width W21 is located at a position where the third connecting portion 18 is offset from the first magnetic column 11, the second magnetic column 12 and the third magnetic column 13. The second width W22 is located at a position where the third connecting portion 18 runs through the first magnetic column 11, the second magnetic column 12 and the third magnetic column. In the embodiment, the first width W21 is greater than the second width W22. The first width W21 and the second width W22 are different from each other. In the embodiment, the position where the third connecting portion 18 runs through the first magnetic column 11, the second magnetic column 12 and the third magnetic column 13 has the second width W22 less than the first width W21 of other positions of the third connecting portion 18. In that, when the leakage reluctance R0 is maintained and the reluctance R1 of the first magnetic column 11, the second magnetic column 12 and the third magnetic column 13 is reduced, the coupling coefficient is improved.

In summary, the present disclosure provides a magnetic component and a manufacturing method thereof. The magnetic core and the winding sets are combined to form a low profile magnetic component. The overall height of the magnetic component is thin and suitable for applications critical to the requirements of height. The thickness and cross-sectional area of the winding sets are large, and the DC resistance is small, which can reduce the loss of the winding sets of the inductor and strengthen the strength of the structure at the same time. Moreover, it benefits to obtain lower thermal resistance in the height direction through the exposure of the winding sets and the extension of the connection terminals. In addition, the manufacturing process of the magnetic component is simplified, the winding sets can be pre-formed, and it is not necessary to bend the magnetic core with the magnetic core to damage the magnetic core. Consequently, the purposes of simplifying the manufacturing process and reducing the production cost are achieved at the same time. On the other hand, the dimensional design and the selected materials of the magnetic core are more conducive to optimizing the performance of the magnetic component.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic component comprising:

a magnetic core comprising a first magnetic column, a second magnetic column, a third magnetic column, a first connecting portion and a second connecting portion, wherein the first connecting portion and the second connecting portion are connected with each other through the first magnetic column, the second magnetic column and the third magnetic column to form a first side and a second side, wherein the first side and the second side are opposite to each other, the first magnetic column is located between the second magnetic column and the third magnetic column, wherein each of the first connecting portion and the second connecting portion comprises a pair of first air gaps, respectively, and the pair of first air gaps spatially correspond to two opposite lateral sides of the first magnetic column, respectively; and a first winding set and a second winding set respectively made by a flat conductive body in flatwise winding on the first magnetic column, and spaced apart with each other at a distance, wherein the first winding set comprises a first horizontal portion and two first conducting portions, and the two first conducting portions are connected to each other through the first horizontal portion; wherein the second winding set comprises a second horizontal portion and two second conducting portions, and the two second conducting portions are connected to each other through the second horizontal portion, wherein the first horizontal portion and the second horizontal portion are at least partially exposed to the first side, and the two first conducting portions and the two second conducting portions are extended to the second side to form two surface mounting pads of the first winding set and two mounting pads of the second winding set, respectively.

2. The magnetic component according to claim 1, wherein the first magnetic column comprises a first limitation part, wherein the first limitation part is disposed between the first horizontal portion and the second horizontal portion.

3. The magnetic component according to claim 1, wherein at least one of the second magnetic column and the third magnetic column comprises a recess to accommodate a connection terminal of the corresponding first winding set or the corresponding second winding set.

4. The magnetic component according to claim 1, wherein the pair of the first air gaps of the first connecting portion and the pair of the first air gaps of the second connecting portion are adjacent to the two opposite lateral sides of the first magnetic column.

5. The magnetic component according to claim 1, wherein the pair of the first air gaps of the first connecting portion are adjacent to a lateral side of the second magnetic column and a lateral side of the third magnetic column, and the pair of the first air gaps of the second connecting portion are adjacent to a lateral side of the second magnetic column and a lateral side of the third magnetic column.

6. The magnetic component according to claim 1, wherein the magnetic core further comprises a third connecting portion, extended from two opposite lateral sides of the first magnetic column toward the second magnetic column and the third magnetic column, respectively, wherein the third connecting portion is located between the first connecting portion and the second connection portion, and the third connecting portion is located between the first winding set and the second winding set.

7. The magnetic component according to claim 6, wherein the third connecting portion comprises a pair of second air gaps located between the first magnetic column and the second magnetic column, and located between the first magnetic column and the third magnetic column, respectively.

8. The magnetic component according to claim 7, wherein the width of the third connecting portion is greater than the width of the first connecting portion and the width of the second connecting portion, wherein the length of the second air gap is greater than the length of the first air gap.

9. The magnetic component according to claim 7, wherein the pair of second air gaps are adjacent to the two opposite lateral sides of the first magnetic column, respectively.

10. The magnetic component according to claim 7, wherein the pair of second air gaps are adjacent to a lateral side of the second magnetic column and a lateral side of the third magnetic column, respectively.

11. A magnetic component comprising:

a magnetic core comprising a first magnetic column, a second magnetic column, a third magnetic column, a first connecting portion, a second connecting portion and a third connecting portion, wherein the first connecting portion and the second connecting portion are connected with each other through the first magnetic column, the second magnetic column and the third magnetic column to form a first side and a second side, the first side and the second side are opposite to each other, the first magnetic column is located between the second magnetic column and the third magnetic column, and the third connecting portion is located between the first connecting portion and the second connecting portion, wherein the third connecting portion has a relative permeability lower than that of each of the first magnetic column, the second magnetic column, the third magnetic column, the first connecting portion and the second connecting portion; and a first winding set and a second winding set disposed on the first magnetic column of the magnetic core, and spaced apart by the third connecting portion, wherein the first winding set comprises a first horizontal portion and two first conducting portions, and the two first conducting portions are connected to each other through the first horizontal portion; wherein the second winding set comprises a second horizontal portion and two second conducting portions, and the two second conducting portions are connected to each other through the second horizontal portion, wherein the first horizontal portion and the second horizontal portion are at least partially exposed to the first side, and the two first conducting portions and the two second conducting portions are extended to the second side, wherein the first winding set and the second winding set are made by a flat conductive body, respectively.

12. The magnetic component according to claim 11, wherein the third connecting portion includes a powder core material, wherein the first magnetic column, the second magnetic column, the third magnetic column, the first connecting portion and the second connecting portion include a ferrite material.

13. The magnetic component according to claim 11, wherein the third connecting portion runs through the first magnetic column, the second magnetic column and the third magnetic column.

14. The magnetic component according to claim 13, wherein the third connecting portion includes at least one first width and at least one second width, wherein the first width is located at a position where the third connecting portion is offset from the first magnetic column, the second magnetic column and the third magnetic column, and the second width is located at a position selected from where the third connecting portion runs through the first magnetic column, the second magnetic column and the third magnetic column, wherein the first width and the second width are different from each other.

15. The magnetic component according to claim 14, wherein the first width is greater than the second width.

16. The magnetic component according to claim 13, wherein each of the first magnetic column, the second magnetic column and the third magnetic column comprises a pair of first air gaps, respectively, and the pair of first air gaps spatially correspond to two opposite lateral sides of the third connecting portion, respectively.

17. The magnetic component according to claim 16, wherein the first air gap has a length equal to zero.

18. The magnetic component according to claim 13, wherein the magnetic core is composed of two E-shaped ferrite cores and an I-shaped powder core, and the I-shaped powder core is disposed between the two E-shaped ferrite cores, and the first winding set and the second winding set are wound around middle columns of the two E-shaped ferrite cores, respectively.

19. A power module comprising:

a magnetic component comprising:

a magnetic core comprising a first magnetic column, a second magnetic column, a third magnetic column, a first connecting portion and a second connecting portion, wherein the first connecting portion and the second connecting portion are connected with each other through the first magnetic column, the second magnetic column and the third magnetic column to form a first side and a second side, wherein the first side and the second side are opposite to each other, the first magnetic column is located between the second magnetic column and the third magnetic column, wherein each of the first connecting portion and the second connecting portion comprises a pair of first air gaps, respectively, and the pair of first air gaps spatially correspond to two opposite lateral sides of the first magnetic column, respectively; and a first winding set and a second winding set respectively made by a flat conductive body in flatwise winding on the first magnetic column, and spaced apart with each other at a distance, wherein the first winding set comprises a first horizontal portion and two first conducting portions, and the two first conducting portions are connected to each other through the first horizontal portion; wherein the second winding set comprises a second horizontal portion and two second conducting portions, and the two second conducting portions are connected to each other through the second horizontal portion, wherein the first horizontal portion and the second horizontal portion are at least partially exposed to the first side, the two first conducting portions are extended to the second side to form a first connection terminal and a second connection terminal of the first winding set, and the two second conducting portions are extended to the second side to form a first connection terminal and a second connection terminal of the second winding set, respectively; and a first switch unit and a second switch unit, wherein the first connection terminal of the first winding set is connected to the first switch unit, and the first connection terminal of the second winding set is connected to the second switch unit, wherein when a first current flows through the second winding set from the first connection terminal to the second connection terminal and a second current flows through the first winding set from the first connection terminal to the second connection terminal, respectively, two magnetic fluxes are generated to have directions opposite to each other in the first magnetic column;

wherein a connection point of the second connection terminal of the first winding set and the second connection terminal of the second winding set is served as an output terminal of the power module.

20. A power module comprising:

a magnetic component comprising:

a magnetic core comprising a first magnetic column, a second magnetic column, a third magnetic column, a first connecting portion, a second connecting portion and a third connecting portion, wherein the first connecting portion and the second connecting portion are connected with each other through the first magnetic column, the second magnetic column and the third magnetic column to form a first side and a second side, the first side and the second side are opposite to each other, the first magnetic column is located between the second magnetic column and the third magnetic column, and the third connecting portion is located between the first connecting portion and the second connecting portion, wherein the third connecting portion has a relative permeability lower than that of each of the first magnetic column, the second magnetic column, the third magnetic column, the first connecting portion and the second connecting portion; and a first winding set and a second winding set disposed on the first magnetic column of the magnetic core, and spaced apart by the third connecting portion, wherein the first winding set comprises a first horizontal portion and two first conducting portions, and the two first conducting portions are connected to each other through the first horizontal portion; wherein the second winding set comprises a second horizontal portion and two second conducting portions, and the two second conducting portions are connected to each other through the second horizontal portion, wherein the first horizontal portion and the second horizontal portion are at least partially exposed to the first side, and the two first conducting portions and the two second conducting portions are extended to the second side, wherein the first winding set and the second winding set are made by a flat conductive body, respectively; and a first switch unit and a second switch unit, wherein a first connection terminal of the first winding set is connected to the first switch unit, and a first connection terminal of the second winding set is connected to the second switch unit, wherein when a first current flows through the second winding set from the first connection terminal to a second connection terminal and a second current flows through the first winding set from the first connection terminal to a second connection terminal, respectively, two magnetic fluxes are generated to have directions opposite to each other in the first magnetic column;

wherein a connection point of the second connection terminal of the first winding set and the second connection terminal of the second winding set is served as an output terminals of the power module.

* * * * *